US010656575B2

(12) United States Patent
Harada

(10) Patent No.: US 10,656,575 B2
(45) Date of Patent: May 19, 2020

(54) HEATING SYSTEM HAVING CURRENT-SENSING CONTROL CIRCUIT

(71) Applicant: BROTHER KOGYO KABUSHIKI KAISHA, Nagoya-shi, Aichi-ken (JP)

(72) Inventor: Yuya Harada, Anjo (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/364,610

(22) Filed: Mar. 26, 2019

(65) Prior Publication Data

US 2019/0302663 A1 Oct. 3, 2019

(30) Foreign Application Priority Data

Mar. 30, 2018 (JP) ..... 2018-068511

(51) Int. Cl.
*G03G 15/20* (2006.01)
*H05B 1/02* (2006.01)

(52) U.S. Cl.
CPC ..... *G03G 15/2039* (2013.01); *H05B 1/0241* (2013.01)

(58) Field of Classification Search
CPC ..... G03G 15/2039; H05B 1/0241
See application file for complete search history.

(56) References Cited

U.S. PATENT DOCUMENTS

2014/0348528 A1* 11/2014 Tamaki ..... G03G 15/205 399/69
2017/0038711 A1* 2/2017 Kirikubo ..... G03G 15/2039

FOREIGN PATENT DOCUMENTS

| | | | |
|---|---|---|---|
| JP | 2003-86332 | A | 3/2003 |
| JP | 2013-61900 | A | 4/2013 |
| JP | 2013-66334 | A | 4/2013 |
| JP | 2013-70526 | A | 4/2013 |
| JP | 2013-97602 | A | 5/2013 |
| JP | 2014-183611 | A | 9/2014 |
| JP | 61-23325 | B2 | 5/2017 |

OTHER PUBLICATIONS

Machine translation of JP-2014-153520 (Year: 2014).*

* cited by examiner

*Primary Examiner* — G. M. A Hyder
(74) *Attorney, Agent, or Firm* — Merchant & Gould P.C.

(57) ABSTRACT

A heating system includes a heater, a current sensor outputting a current monitoring signal indicating a current level of an alternating current power signal, and a switch providing alternating current to the heater. The heating system also includes a controller that controls operation of the switch. The controller activates the switch during a portion of a half cycle of the alternating current power signal having increasing amplitude. Upon the current monitoring signal reaching a predetermined threshold within the half cycle, the controller deactivates the switch. The heating system is useable within an image forming apparatus.

14 Claims, 11 Drawing Sheets

HEATING SYSTEM HAVING CURRENT-SENSING CONTROL CIRCUIT

CROSS-REFERENCE TO RELATED APPLICATION

This application claims priority from Japanese Patent Application No. 2018-068511 filed on Mar. 30, 2018, the content of which is incorporated herein by reference in its entirety.

TECHNICAL FIELD

Aspects disclosed herein relate to a heating system.

BACKGROUND

In some system including a plurality of heaters, a known technique for controlling voltage application timings has been used. More specifically, the technique enables application of voltage to the heaters at respective different timings.

SUMMARY

A need has arisen to reduce or prevent an excessive flow of consumption current such as inrush current in a heating system including one or more heaters. Another need has also arisen to shorten time required for the one or more heaters to reach respective predetermined temperatures.

Accordingly, one or more aspects of the disclosure provide for a heating system that may shorten time required for the one or more heaters to reach respective predetermined temperatures while limiting power supply to the one or more heaters.

In a first aspect, a heating system includes a first heater, a current sensor connected in series to the first heater, and a first switch connected in series to the first heater. The first switch is configured to: in response to receiving a first ON signal, change to a conducting state to supply an alternating current signal to the first heater; and in response to receiving a first OFF signal, change to a non-conducting state to halt supply of the alternating current signal to the first heater. The heating system further includes a controller configured to: output the first ON signal to the first switch at a first time, the first time occurring during a portion of a half cycle of the alternating current signal having increasing amplitude; and output the first OFF signal to the first switch at a second time in response to change of a signal received from the current sensor from being less than a first threshold to being within a predetermined range, the predetermined range having a minimum value equal to the first threshold and a maximum value equal to a second threshold.

In a second aspect, a heating system includes a first heater and a second heater. The heating system also includes a first switch electrically connected between an alternating current power signal and the first heater. The heating system also includes a second switch electrically connected between the alternating current power signal and the second heater. The heating system also includes a current sensor configured to output a current monitoring signal indicating a current level of the alternating current power signal. The heating system further includes a controller electrically connected to the first switch and the second switch. The controller receives the current monitoring signal from the current sensor. The controller is configured to: activate the first switch and the second switch to provide the alternating current power signal to the first heater and the second heater during a portion of a half cycle of the alternating current power signal having increasing amplitude; and upon the current monitoring signal reaching a predetermined threshold within the half cycle, deactivating at least one of the first switch or the second switch to electrically disconnect the alternating current power signal from the corresponding first or second heater.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

First Illustrative Embodiment

Figure 1:
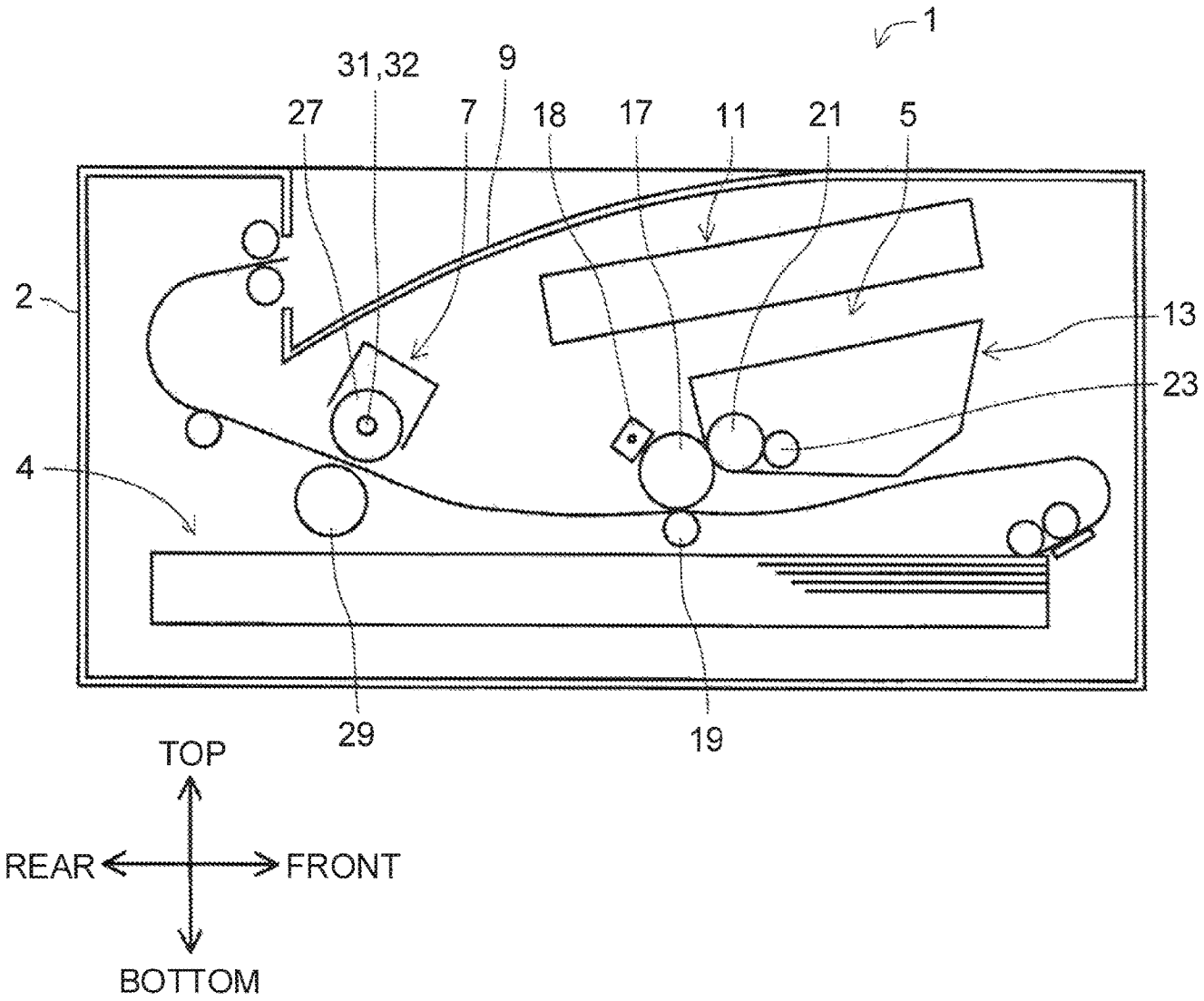
FIG. 1 is a sectional view illustrating a laser printer in a first illustrative embodiment according to one or more aspects of the disclosure.

A first illustrative embodiment will be described with reference to the accompanying drawings. FIG. 1 is a sectional view illustrating a monochrome laser printer 1 in the first illustrative embodiment according to one or more aspects of the disclosure. In the printer 1, an image forming unit 5 forms a toner image onto a sheet fed from a tray 4 disposed in a lower portion of a casing 2. A fixing device 7 then thermally fixes the toner image on the sheet. Thereafter, the printer 1 discharges the sheet onto a discharge tray 9 defined at the top of the casing 2. Hereinafter, an explanation will be provided with reference to directions, top, bottom, front, and rear, as defined in FIG. 1. The right and left of the printer 1 are defined as viewed from the front of the printer 1. These directions will be used throughout the following explanation.

The image forming unit 5 includes a scanner 11, a developer cartridge 13, a photosensitive drum 17, a charger 18, and a transfer roller 19. The scanner 11 is disposed in an upper portion of the casing 2. The scanner 11 emits a laser beam from a laser emitter (not illustrated) onto a circumferential surface of the photosensitive drum 17 via a polygon mirror, a reflector, and a lens (not illustrated).

The developer cartridge 13 is detachably attachable to the casing 2 of the printer 1. The developer cartridge 13 stores toner therein. The developer cartridge 13 includes a developing roller 21 and a supply roller 23, which are disposed facing each other. The developing roller 21 also faces the photosensitive drum 17. The supply roller 23 supplies toner to the developing roller 21 from the developer cartridge 13.

The charger 18 is disposed obliquely above and further to the rear than at least a portion of the photosensitive drum 17 while being spaced from the photosensitive drum 17. The transfer roller 19 is disposed below the photosensitive drum 17 and faces the photosensitive drum 17. For example, the charger 18 positively and uniformly charges the circumferential surface of the photosensitive drum 17 while the photosensitive drum 17 rotates. Thereafter, the scanner 11 forms an electrostatic latent image onto the charged circumferential surface of the photosensitive drum 17 using a laser beam. Subsequently, the developing roller 21 rotates to supply toner onto the circumferential surface of the photosensitive drum 17 having the electrostatic latent image. The photosensitive drum 17 thus has a toner image on its circumferential surface. The transfer roller 19 then transfers the toner image onto a sheet by a bias applied to the transfer roller 19 while the sheet passes between the photosensitive drum 17 and the transfer roller 19.

The fixing device 7 is disposed downstream from the image forming unit 5 in a sheet conveying direction (in a rear portion of the printer 1). The fixing device 7 includes a fixing roller 27, a pressure roller 29, a main heater 31, and an auxiliary heater 32. The pressure roller 29 presses the fixing roller 27. The main heater 31 and the auxiliary heater 32 are configured to heat the fixing roller 27. The fixing roller 27 rotates by driving of an electronic motor (not illustrated) controlled by a controller 33 (refer to FIG. 2). The fixing roller 27 heats toner on a sheet while applying a conveying force to the sheet. The pressure roller 29 rotates by rotation of the fixing roller 27 while applying pressure toward the fixing roller 27. The main heater 31 and the auxiliary heater 32 may be halogen heaters. The main heater 31 and the auxiliary heater 32 are each configured to be energized or de-energized by control of the controller 33 of a heating system 30 (refer to FIG. 2). The main heater 31 includes end portions and a middle portion between the end portions in its axial direction. The main heater 31 is configured such that the middle portion generates more heat than the end portions. The main heater 31 is disposed within an internal space of the fixing roller 27 while the middle portion of the main heater 31 corresponds to a middle portion of the fixing roller 27 in an axial direction of the fixing roller 27. The auxiliary heater 32 includes end portions and a middle portion between the end portions in its axial direction. The auxiliary heater 32 is configured such that the end portions generate more heat than the middle portion. The auxiliary heater 32 is also disposed within the internal space of the fixing roller 27 while the end portions of the auxiliary heater 32 correspond to respective end portions of the fixing roller 27 in the axial direction of the fixing roller 27.

Figure 2:
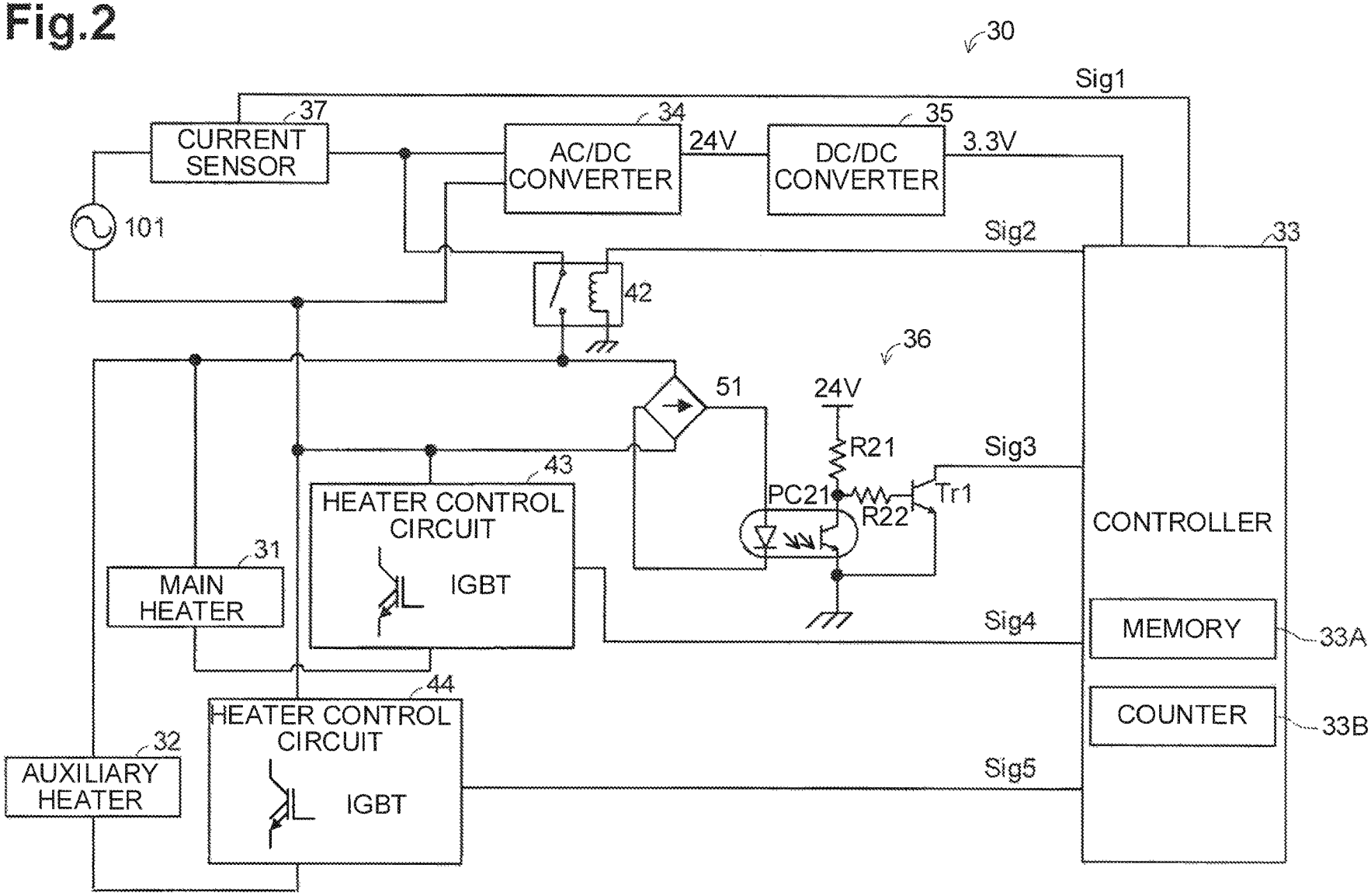
FIG. 2 is a circuit diagram of a heating system in the first illustrative embodiment according to one or more aspects of the disclosure.

As illustrated in FIG. 2, the heating system 30 includes the main heater 31, the auxiliary heater 32, the controller 33, an AC/DC converter 34, a DC/DC converter 35, a zero-crossing detector circuit 36, a current sensor 37, a relay 42, and heater control circuits 43 and 44. In one example, the controller 33 may mainly include one or more programs executed on a CPU. In another example, the controller 33 may include dedicated hardware such as an ASIC. In still another example, the controller 33 may be configured to operate by combined execution of processing executed by software and processing executed by hardware. The controller 33 includes a memory 33A and a counter 33B. The memory 33A includes, for example, a RAM, a ROM, and a flash memory. The memory 33A is configured to store various information on control and processing, and programs for heater control processing. The counter 33B is configured to measure time. The heating system 30 is installed within the printer 1.

The main heater 31 and the auxiliary heater 32 are each configured to heat by power supplied by an AC supply 101. The auxiliary heater 32 is connected in parallel to the main heater 31. In the first illustrative embodiment, the main heater 31 consumes more power than the auxiliary heater 32. The AC/DC converter 34 converts, for example, 100 V alternating voltage into 24 V direct voltage and outputs 24 V direct voltage to the DC/DC converter 35. The DC/DC converter 35 converts 24 V direct voltage into 3.3 V direct voltage and supplies 3.3 V direct voltage to, for example, the controller 33. The current sensor 37 is connected in series to the main heater 31 and the auxiliary heater 32. The current sensor 37 outputs, to the controller 33, a signal Sig1 responsive to intensity of current that flows from the AC supply 101 to one or the other or both of the main heater 31 and the auxiliary heater 32. The main heater 31 and the auxiliary heater 32 both consume current considerably greater than the controller 33 or others. Thus, the controller 33 ignores current consumed by the controller 33 or others and regards the intensity of current measured by the current sensor 37 as the intensity of current that passes through one or the other or both of the main heater 31 and the auxiliary heater 32. The current sensor 37 includes a Hall element and an amplifier circuit. The current sensor 37 converts a magnetic field occurring in proportion to current into voltage by the Hall effect of the Hall element. The current sensor 37 outputs, to the controller 33, the converted voltage amplified by the amplifier circuit. In another example, instead of the Hall element, the current sensor 37 may include a fluxgate magnetic sensor. In the following explanation, current that passes through one or the other or both of the main heater 31 and the auxiliary heater 32, i.e., current that passes through the current sensor 37, may be referred to as heater current. The relay 42 switches between electrical connection and disconnection of the AC supply 101 to and from each of the main heater 31 and the auxiliary heater 32, based on a signal Sig2 outputted by the controller 33.

In response to detecting zero-crossing of alternating current supplied by the AC supply 101, the zero-crossing detector circuit 36 outputs a signal Sig3 to the controller 33. The signal Sig3 may be a pulse signal. More specifically, for example, the zero-crossing detector circuit 36 includes a diode bridge 51, a photocoupler PC21, resistors R21 and R22, and a transistor Tr1. The transistor Tr1 may be an NPN bipolar transistor. The diode bridge 51 provides full-wave rectification for the AC supply 101. The full-wave rectified power of the AC supply 101 is then applied to an LED of the photocoupler PC21. The photocoupler PC21 includes a phototransistor having a collector terminal and an emitter terminal. The collector terminal is connected to a 24 V DC supply via the resistor R21. The emitter terminal is grounded. The transistor Tr1 has a base terminal, a collector terminal, and an emitter terminal. The base terminal is connected to a connection point of the resistor R21 and the photocoupler PC21. The collector terminal is connected to the controller 33. The emitter terminal is grounded. A line connecting between the collector terminal of the transistor Tr1 and the controller 33 is pulled up by power supply voltage inside the controller 33. The LED of the photocoupler PC21 is configured to emit light, whose amount corresponds to voltage applied thereto. As voltage applied to the LED of the photocoupler PC21 becomes lower, an ON-resistance of the phototransistor of the photocoupler PC21 increases and a base voltage of the transistor Tr1 thus becomes higher. In response to the base voltage of the transistor Tr1 exceeding a threshold, the transistor Tr1 turns on and the signal Sig3 is changed to a low level. Therefore, the signal Sig3 outputted by the zero-crossing detector circuit 36 indicates a low level before and after each zero-crossing of alternating current supplied by the AC supply 101 occurs. The controller 33 determines, based on a signal Sig3 inputted thereto, a zero-crossing timing at which alternating current that flows between the AC supply 101 and the zero-crossing detector circuit 36 crosses zero.

The heater control circuits 43 and 44 each include an insulated gate bipolar transistor ("IGBT"). The IGBT of the heater control circuit 43 is connected in series to the main heater 31 and in parallel to the auxiliary heater 32. The IGBT of the heater control circuit 44 is connected in serial to the auxiliary heater 32 and is parallel to the main heater 31. The IGBT of the heater control circuit 43 has a collector terminal and an emitter terminal, one of which is connected to one of poles of the AC supply 101 and the other of which is connected to the other of the poles of the AC supply 101 via the main heater 31 and the relay 42. The heater control circuit 43 receives a signal Sig4 outputted by the controller 33. The signal Sig4 is for controlling energization and de-energization of the main heater 31. The heater control circuit 43 changes between a conducting state and a non-conducting state in accordance with a level of the signal Sig4. More specifically, for energizing the main heater 31, the controller 33 changes the signal Sig4 to a level that causes the IGBT of the heater control circuit 43 to have the conducting state. The signal Sig4 having the level that causes the IGBT of the heater control circuit 43 to have the conducting state is an example of a second ON signal. In response to the heater control circuit 43 receiving such a signal Sig4 from the controller 33, the IGBT of the heater control circuit 43 changes to the conducting state, thereby enabling the main heater 31 to be energized. For de-energizing the main heater 31, the controller 33 changes the signal Sig4 to another level that causes the IGBT of the heater control circuit 43 to have the non-conducting state. The signal Sig4 having the level that causes the IGBT of the heater control circuit 43 to have the non-conducting state is an example of a second OFF signal. In response to the heater control circuit 43 receiving such a signal Sig4 from the controller 33, the IGBT of the heater control circuit 43 changes to the non-conducting state, thereby enabling the main heater 31 to be de-energized. The auxiliary heater 32 is controlled in the same manner. That is, the IGBT of the heater control circuit 44 has a collector terminal and an emitter terminal, one of which is connected to one of poles of the AC supply 101 and the other of which is connected to the other of the poles of the AC supply 101 via the auxiliary heater 32 and the relay 42. The heater control circuit 44 receives a signal Sig5 outputted by the controller 33. The signal Sig5 is for controlling energization and de-energization of the auxiliary heater 32. The heater control circuit 44 changes between a conducting state and a non-conducting state in accordance with a level of the signal Sig5. More specifically, for energizing the auxiliary heater 32, the controller 33 changes the signal Sig5 to a level that causes the IGBT of the heater control circuit 44 to have the conducting state. In response to the heater control circuit 43 receiving a signal Sig5 having such a level from the controller 33, the IGBT of the heater control circuit 44 changes to the conducting state, thereby enabling the auxiliary heater 32 to be energized. For de-energizing the auxiliary heater 32, the controller 33 changes the signal Sig5 to another level that causes the IGBT of the heater control circuit 44 to have the non-conducting state. The signal Sig5 having the level that causes the IGBT of the heater control circuit 44 to have the non-conducting state is an example of a first OFF signal. In response to the heater control circuit 43 receiving such a signal Sig5 from the controller 33, the IGBT of the heater control circuit 44 changes to the non-conducting state, thereby enabling the auxiliary heater 32 to be de-energized. In the following explanation, the phrase indicating that "the controller 33 causes the IGBT of the heater control circuit 43 to have the conducting state by inputting the signal Sig4 having a predetermined level to the heater control circuit 43" is referred to, for example, as "the controller 33 turns the main heater 31 on" or "the main heater 31 is turned on". The phrase indicating that "the controller 33 causes the IGBT of the heater control circuit 44 to have the conducting state by inputting the signal Sig5 having a predetermined level to the heater control circuit 44" is referred to, for example, as "the controller 33 turns the auxiliary heater 32 on" or "the auxiliary heater 32 is turned on". Further, the phrase indicating that "the controller 33 causes the IGBT of the heater control circuit 43 to have the non-conducting state by inputting, to the heater control circuit 43, the signal Sig4 having another level different from the predetermined level" is referred to, for example, as "the controller 33 turns the main heater 31 off" or "the main heater 31 is turned off". The phrase indicating that "the controller 33 causes the IGBT of the heater control circuit 44 to have the non-conducting state by inputting, to the heater control circuit 44, the signal Sig5 having another level different from the predetermined level" is referred to, for example, as "the controller 33 turns the auxiliary heater 32 off" or "the auxiliary heater 32 is turned off".

Figure 3:
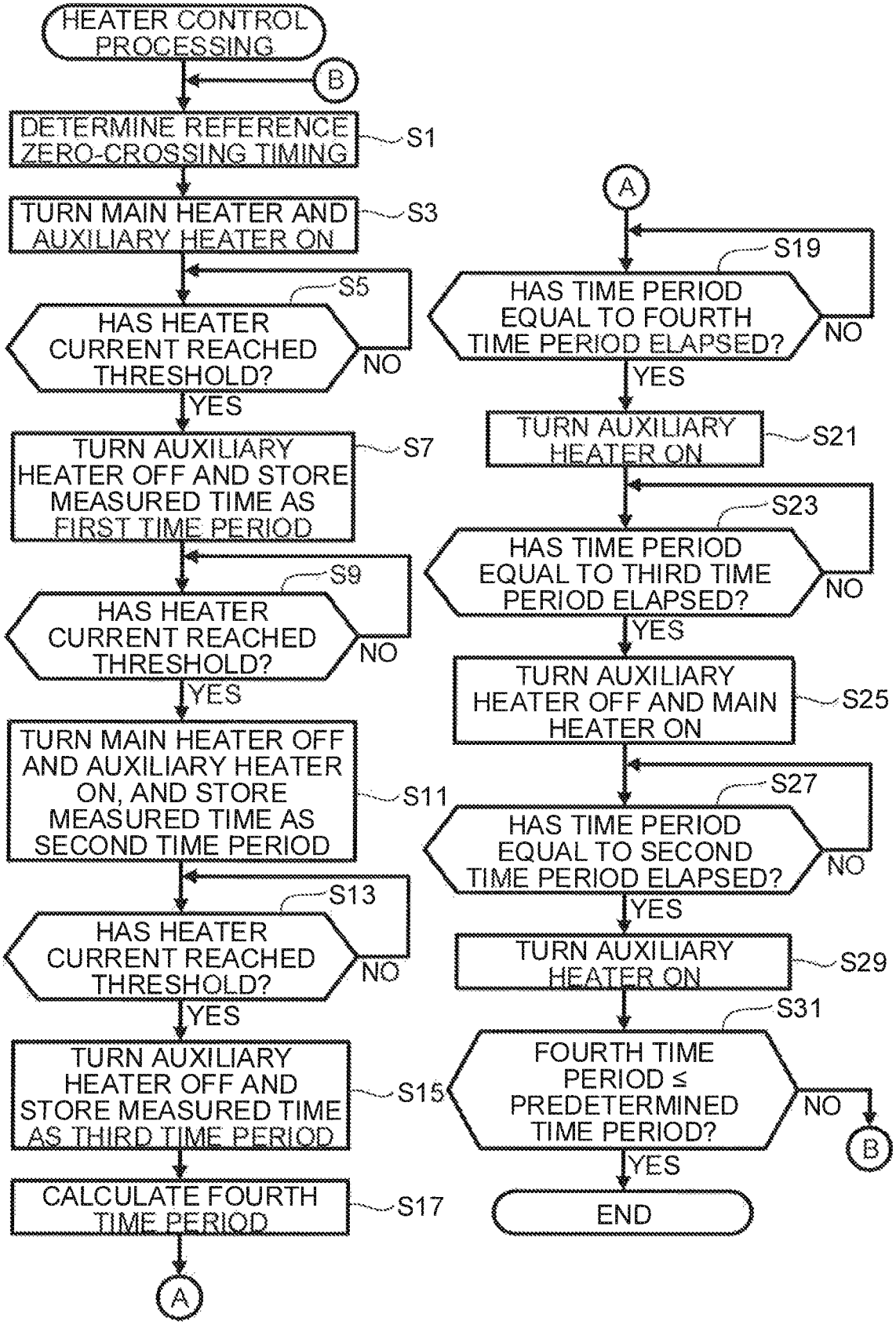
FIG. 3 is a flowchart of heater control processing in the first illustrative embodiment according to one or more aspects of the disclosure.

In response to, for example, turning-on of the power of the printer 1, the controller 33 starts heater control processing (refer to FIG. 3). In response to the turning-on of the printer 1, the controller 33 changes the signal Sig2 to the level that causes a contact of the relay 42 to be closed.

The controller 33 determines a reference zero-crossing timing based on an inputted signal Sig3 (e.g., step S1). Subsequent to step S1, at the reference zero-crossing timing, the controller 33 turns both of the main heater 31 and the auxiliary heater 32 on and causes the counter 33B to start measuring time (e.g., step S3). Subsequent to step S3, the controller 33 determines whether the heater current detected based on a currently input signal Sig1 has reached a threshold TH1 prestored in the memory 33A (e.g., step S5). The threshold TH1 is defined by the intensity of current that does not depend on the direction of current flow. That is, in step S5, the controller 33 determines whether an absolute value of the heater current detected based on the currently input signal Sig1 has reached the threshold TH1. The controller 33 executes the same determination in similar steps using the threshold TH1 subsequently executed. The threshold TH1 may indicate a lower limit of a current range ΔIa having an upper limit that may be equal to rated current TH2. If the controller 33 determines that the heater current has not reached the threshold TH1 (e.g., NO in step S5), the routine returns to step S5. The controller 33 repeats the processing of step S5 until the controller 33 makes a positive determination (e.g., "YES") in step S5. If the controller 33 determines that the heater current has reached the threshold TH1 (e.g., YES in step S5), the controller 33 turns the auxiliary heater 32 off. An increase of the heater current from a timing at which the controller 33 makes a negative determination (e.g., "NO") in step S5 to a timing at which the controller 33 then makes a positive determination (e.g., "YES") in step S5 is smaller than difference between the threshold TH1 and the rated current TH2 of the current range ΔIa. In each of steps S9 and S13, the controller 33 executes the same determination as the controller 33 executes in step S5. Further, in step S7, the controller 33 causes the counter 33B to stop measuring time, and stores the measured time in the memory 33A as a time period TD1. In addition, the controller 33 causes the counter 33B to reset and newly start measuring time (e.g., step S7). Subsequent to step S7, the controller 33 determines whether the heater current detected based on the signal Sig1 has reached the threshold TH1 (e.g., step S9). During this period, the auxiliary heater 32 stays off. Therefore, the heater current flowing during this period includes current passing through the main heater 31 only. If the controller 33 determines that the heater current has not reached the threshold TH1 (e.g., NO in step S9), the routine returns to step S9. The controller 33 repeats the processing of step S9 until the controller 33 makes a positive determination (e.g., "YES") in step S9. If the controller 33 determines that the heater current has reached the threshold TH1 (e.g., YES in step S9), the controller 33 turns the main heater 31 off and the auxiliary heater 32 on. Subsequent to step S9, the controller 33 causes the counter 33B to stop measuring time, and stores the measured time in the memory 33A as a time period TD2. In addition, the controller 33 causes the counter 33B to reset and newly start measuring time (e.g., step S11).

Subsequent to step S11, the controller 33 determines whether the heater current detected based on the currently input signal Sig1 has reached the threshold TH1 (e.g., step S13). During this period, the main heater 31 stays off. Therefore, the heater current flowing during this period includes current passing through the auxiliary heater 32 only. If the controller 33 determines that the heater current has not reached the threshold TH1 (e.g., NO in step S13), the routine returns to step S13. The controller 33 repeats the processing of step S13 until the controller 33 makes a positive determination (e.g., "YES") in step S13. If the controller 33 determines that the heater current has reached the threshold TH1 (e.g., YES in step S13), the controller 33 turns the auxiliary heater 32 off. Subsequent to step S13, the controller 33 causes the counter 33B to stop measuring time, and stores the measured time in the memory 33A as a time period TD3. In addition, the controller 33 causes the counter 33B to reset and newly start measuring time (e.g., step S15). Subsequent to step S15, the controller 33 calculates a time period TD4 using a time period T of alternating current supplied by the AC supply 101 and stores the obtained time period TD4 in the memory 33A (e.g., step S17). TD4=T/2−(TD1+TD2+TD3)*2

Subsequent to step S17, the controller 33 determines, based on the time being measured by the counter 33B, whether a time period equal to the time period TD4 stored in the memory 33A has elapsed from the start of the processing of step S15 (e.g., step S19). If the controller 33 determines that a time period equal to the time period TD4 has not elapsed yet (e.g., NO in step S19), the routine returns to step S19. The controller 33 repeats the processing of step S19 until the controller 33 makes a positive determination (e.g., "YES") in step S19. If the controller 33 determines that a time period equal to the time period TD4 has elapsed (e.g., YES in step S19), the controller 33 turns the auxiliary heater 32 on, and causes the counter 33B to stop measuring time. Further, the controller 33 causes the counter 33B to reset and newly start measuring time (e.g., step S21). Subsequent to step S21, the controller 33 determines, based on the time being measured by the counter 33B, whether a time period equal to the time period TD3 stored in the memory 33A has elapsed from the start of the processing of step S21 (e.g., step S23). If the controller 33 determines that a time period equal to the time period TD3 has not elapsed yet (e.g., NO in step S23), the routine returns to step S23. The controller 33 repeats the processing of step S23 until the controller 33 makes a positive determination (e.g., "YES") in step S23. If the controller 33 determines that a time period equal to the time period TD3 has elapsed (e.g., YES in step S23), the controller 33 turns the auxiliary heater 32 off and the main heater 31 on. Further, the controller 33 causes the counter 33B to stop measuring time and to reset and newly start measuring time (e.g., step S25).

Subsequent to step S25, the controller 33 determines, based on the time being measured by the counter 33B, whether a time period equal to the time period TD2 stored in the memory 33A has elapsed from the start of the processing of step S25 (e.g., step S27). If the controller 33 determines that a time period equal to the time period TD2 has not elapsed yet (e.g., NO in step S27), the routine returns to step S27. The controller 33 repeats the processing of step S27 until the controller 33 makes a positive determination (e.g., "YES") in step S27. If the controller 33 determines that a time period equal to the time period TD2 has elapsed (e.g., YES in step S27), the controller 33 turns the auxiliary heater 32 on (e.g., step S29). Subsequent to step S29, the controller 33 determines whether the time period TD4 is shorter than or equal to a predetermined time period (e.g., step S31). If the controller 33 determines that the time period TD4 is not shorter than or equal to the predetermined time period (e.g., NO in step S31), the routine returns to step S1. If the controller 33 determines that the time period TD4 is shorter than or equal to the predetermined time period (e.g., YES in step S31), the controller 33 ends the heater control processing. If the routine returns to step S1, the controller 33 starts again the processing of step S3 and its subsequent steps at another determined reference zero-crossing timing. That is, the controller 33 executes processing of steps S1 to S31 during each half cycle of alternating current supplied by the AC supply 101.

Figure 4:
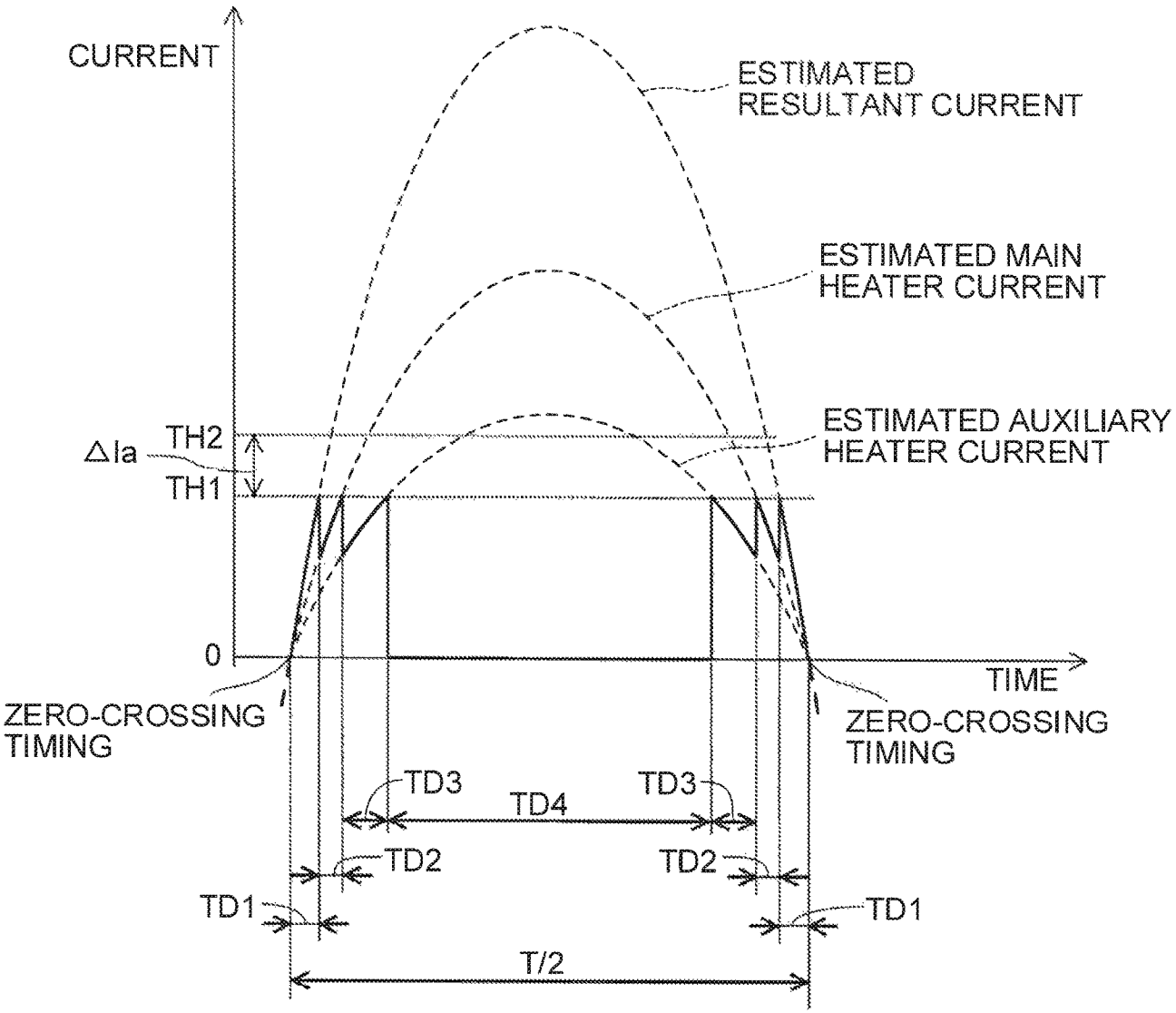
FIG. 4 is a chart showing a waveform transition during a half cycle of heater current in the heater control processing in the first illustrative embodiment according to one or more aspects of the disclosure.

Referring to FIG. 4, the heater control processing will be described. In a waveform chart, a horizontal axis indicates time and a vertical axis indicates current. A waveform of the heater current is indicated by a solid line. A waveform of current that may pass through the main heater 31 that is assumed to have undergone a wave number control is indicated by a dashed line. This current is referred to as an "estimated main heater current". A waveform of current that may pass through the auxiliary heater 32 that is assumed to have undergone the wave number control is indicated by a dashed line. This current is referred to as an "estimated auxiliary heater current". A waveform of resultant current of the current that may pass through the main heater 31 that is assumed to have undergone the wave number control and the current that may pass through the auxiliary heater 32 that is assumed to have undergone the wave number control is indicated by a dashed line. This resultant current is referred to as an "estimated resultant current". In FIGS. 5, 6, 9, and 10, the estimated main heater current, the estimated auxiliary heater current, and the estimated resultant current are indicated in the same manner. In the wave number control, current is continuously applied to either one or both of the main heater 31 and the auxiliary heater 32 in a half cycle of alternating current supplied by the AC supply 101. For example, if the wave number control is executed on the main heater 31, current is continuously applied to the main heater 31 in a half cycle of alternating current supplied by the AC supply 101 from a reference zero-crossing timing which corresponds to the start of the half cycle to the next zero-crossing timing which corresponds to the end of the half cycle. The same wave number control may be executed on the auxiliary heater 32.

In response to the determination of a reference zero-crossing timing in step S1, the main heater 31 and the auxiliary heater 32 are both turned on in step S3. As a phase angle of current in the AC supply 101 increases, the resultant current becomes higher. In response to the resultant current reaching the threshold TH1, the auxiliary heater 32 is turned off in step S7. The time period from the determined zero-crossing timing to the timing at which the auxiliary heater 32 is turned off corresponds to the time period TD1. After the auxiliary heater 32 is turned off in step S7, the heater current flowing currently includes the current that passes through the main heater 31 only and thus the heater current becomes lower. As the phase angle of current in the AC supply 31 increases while only the main heater 31 stays on, the heater current becomes higher. In response to the heater current reaching the threshold TH1, the main heater 31 is turned off and the auxiliary heater 32 is turned on in step S11. The time period from the timing at which the auxiliary heater 32 is turned off to the timing at which the main heater 31 is turned off and the auxiliary heater 32 is turned on corresponds to the time period TD2. The main heater 31 consumes less power than the auxiliary heater 32. Thus, in response to turning the main heater 31 off and the auxiliary heater 32 on in step S11, the heater current becomes lower. As the phase angle of current in the AC supply 32 increases while only the auxiliary heater 32 stays on, the heater current becomes higher. In response to the heater current reaching the threshold TH1, the auxiliary heater 32 is turned off in step S15. That is, the main heater 31 and the auxiliary heater 32 are both turned off and the heater current becomes approximate to zero. The time period from the timing at which the main heater 31 is turned off and the auxiliary heater 32 is turned on to the timing at which the auxiliary heater 32 is turned off corresponds to the time period TD3.

In response to a time period equal to the time period TD4 elapsing since the main heater 31 and the auxiliary heater 32 are both turned off, in step S21, the auxiliary heater 32 is turned on. In response to a time period equal to the time period TD3 elapsing since the auxiliary heater 32 is turned on, in step S23, the auxiliary heater 32 is turned off and the main heater 31 is turned on. In response to a time period equal to the time period TD2 elapsing since the auxiliary heater 32 is turned off and the main heater 31 is turned on, the auxiliary heater 32 is turned on. As described above, in a half cycle, during the period from the reference zero-crossing timing to the timing at which the first one-quarter of the half cycle ends, the main heater 31 stays on for a particular duration. During the remaining period from the timing at which the first one-quarter of the half cycle ends to the next zero-crossing timing in the half cycle, the main heater 31 also stays on for the same duration as the main heater 31 stays on during the first one-quarter of the half cycle. Further, in the half cycle, during the period from the reference zero-crossing timing to the timing at which the first one-quarter of the half cycle ends, the auxiliary heater 32 stays on for a particular duration. During the remaining period from the timing at which the first one-quarter of the half cycle ends to the next zero-crossing timing in the half cycle, the auxiliary heater 32 also stays on for the same duration as the auxiliary heater 32 stays on during the first one-quarter of the half cycle.

Figure 5:
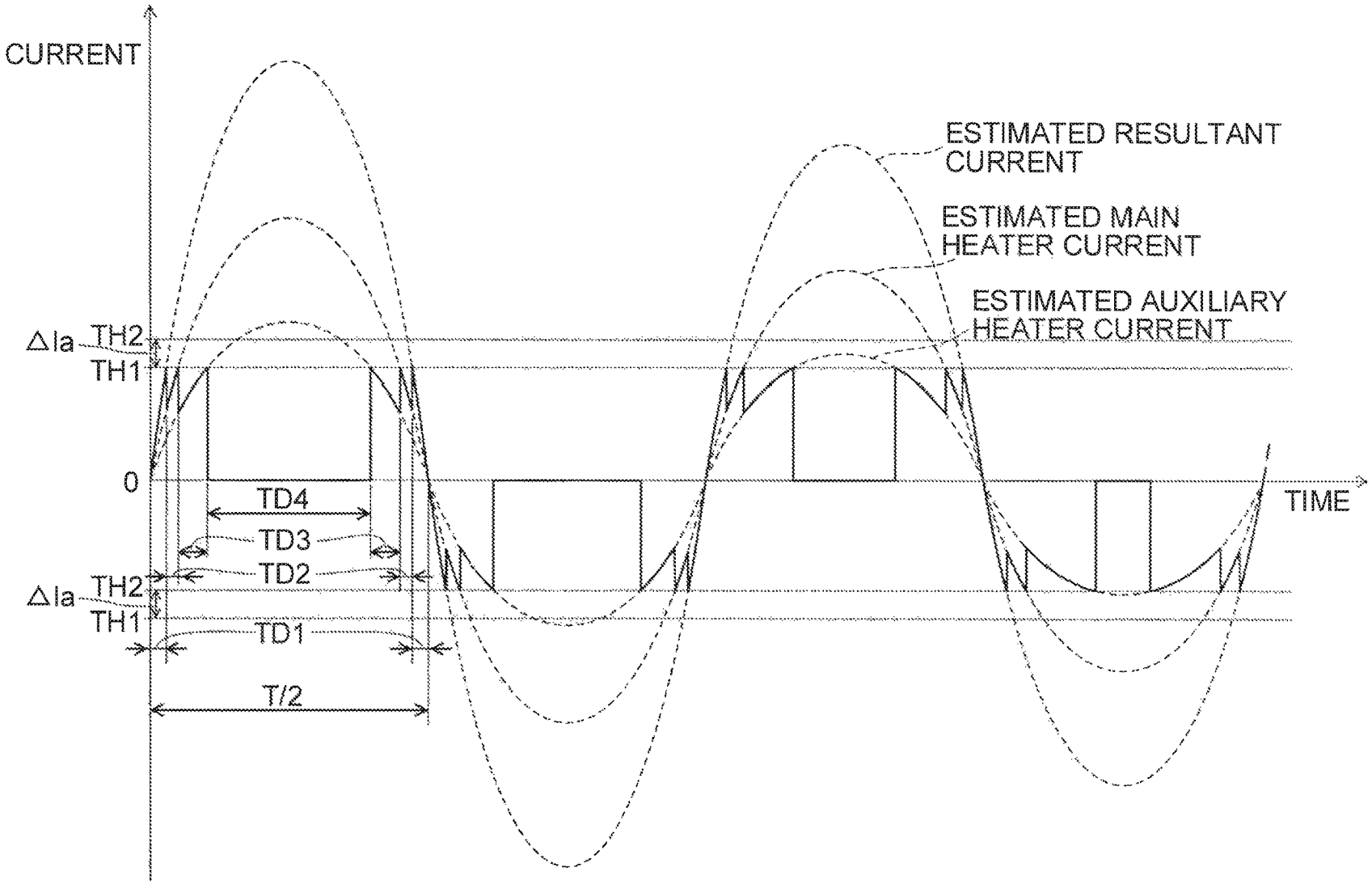
FIG. 5 is a chart showing a waveform transition during each full cycle of the heater current in the heater control processing in the first illustrative embodiment according to one or more aspects of the disclosure.

As the temperature of a halogen heater rises due to a long duration of energization, the resistance of the halogen heater increases. Thus, as illustrated in FIG. 5, the heater current becomes lower gradually over time. Therefore, the duration of each of the time period TD1, the time period TD2, and the time period TD3 in each half cycle becomes longer gradually over time, and the duration of the time period TD4 becomes shorter gradually over time. If the time period TD4 is shorter than or equal to the predetermined time period in a predetermined half cycle of alternating current supplied by the AC supply 101, a peak of current that may pass through the auxiliary heater 32 that is assumed to have undergone the wave number control might not exceed the rated current TH2. Therefore, in each half cycle subsequent to the predetermined half cycle, the controller 33 may execute the wave number control on the sub heater 32. In other words, the auxiliary heater 32 stays on continuously in each half cycle subsequent to the predetermined half cycle. In step S31 (refer to FIG. 3), if the controller 33 determines that the time period TD4 is shorter than or equal to the predetermined time period (e.g., YES in step S31), the controller 33 ends the heater control processing and executes the wave number control on the auxiliary heater 32.

In this example, the printer 1 is an example of an image forming apparatus. The auxiliary heater 32 is an example of a first heater. The main heater 31 is an example of a second heater. The IGBT of the heater control circuit 44 is an example of a first switch. The IGBT of the heater control circuit 43 is an example of a second switch. The signal Sig5 having the level that causes the IGBT of the heater control circuit 44 to have the conducting state is an example of a first ON signal. The signal Sig5 having the level that causes the IGBT of the heater control circuit 44 to have the non-conducting state is an example of a first OFF signal. The signal Sig4 having the level that causes the IGBT of the heater control circuit 43 to have the conducting state is an example of a second ON signal. The signal Sig4 having the level that causes the IGBT of the heater control circuit 43 to have the non-conducting state is an example of a second OFF signal. The threshold TH1 is an example of a first threshold value. The rated current TH2 is an example of a second threshold value.

The first illustrative embodiment may thus achieve effects as follows. During a period from a reference zero-crossing timing to a timing at which the first one-quarter of a half cycle ends, in step S3, the controller 33 changes the signal Sig4 to the level that causes the IGBT of the heater control circuit 43 to have the conducting state and the signal Sig5 to the level that causes the IGBT of the heater control circuit 44 to have the conducting state to cause both the main heater 31 and the auxiliary heater 32 to be energized. In response to the heater current reaching or exceeding the threshold TH1, in step S7, the controller 33 changes the signal Sig5 to the level that causes the IGBT of the heater control circuit 44 to have the non-conducting state to cause the auxiliary heater 32 to be de-energized. Such a control may thus enable both of the main heater 31 and the auxiliary heater 32 to stay energized until the heater current reaches the threshold TH1. The current sensor 37 is provided in the heating system 30 for detecting the change of the intensity of the heater current from the intensity that is below the threshold TH1 to the intensity that exceeds or is equal to the threshold TH1. In response to the current sensor 37 detecting such a change, the auxiliary heater 32 is turned off. If, for example, a heating system does not include such a current sensor, the auxiliary heater 32 may need to be turned off at a timing at which the heater current is surely below the threshold TH1 in order for the heater current not to exceed the rated current TH2 reliably. Nevertheless, according to the first illustrative embodiment, using the current sensor 37 may reduce or prevent the heater current from exceeding the rated current TH2 while FPOT is shortened by delay in the timing for turning the auxiliary heater 32 off. Such a control may enable quick temperature to rise at the main heater 31 and the auxiliary heater 32 while saving power to be supplied to the main heater 31 and the auxiliary heater 32, thereby shortening FPOT.

In response to determining a reference zero-crossing timing in step S1, the controller 33 executes the processing of step S3. In step S3, the controller 33 turns both of the main heater 31 and the auxiliary heater 32 on at the zero-crossing timing. This control may thus enable both the main heater 31 and the auxiliary heater 32 to stay on for a longer period than a case where the controller 33 turns both the main heater 31 and the auxiliary heater 32 on at a timing later than the zero-crossing timing. This may therefore enable shortening of FPOT.

In response to the heater current reaching or exceeding the threshold TH1 while the main heater 31 is energized, in step S11, the controller 33 changes the signal Sig4 to the level that causes the IGBT of the heater control circuit 43 to have the non-conducting state to de-energize the main heater 31. This control may thus enable the heater current to exceed the rated current TH2. Further, this control may enable longer energization of the main heater 31 as compared with a case where the main heater 31 becomes de-energized at a timing at which a time period equal to the time period TD1 has elapsed from the zero-crossing timing corresponding to the start of a half cycle. Such a control may enable further shortening of FPOT. In addition, such a control may reduce or prevent the heater current from exceeding the rated current TH2.

In step S11, while causing the main heater 31 to be de-energized, the controller 33 causes the auxiliary heater 32 to be energized by changing the signal Sig5 to the level that causes the IGBT of the heater control circuit 44 to have the conducting state. The auxiliary heater 32 consumes less power than the main heater 31. Thus, the heater current flowing while only the main heater 31 is energized is smaller than the heater current flowing while only the auxiliary heater 32 is energized. Therefore, if the heater current reaches the threshold TH1 while only the main heater 31 is on, only the auxiliary heater 32 may be turned on while the heater current is below the rated current TH2. Thus, turning the auxiliary heater 32 on in step S11 may enable longer energization of the auxiliary heater 32 without the heater current exceeding the rated current TH2.

In response to the heater current reaching or exceeding the threshold TH1 while the auxiliary heater 32 is energized, in step S15, the controller 33 changes the signal Sig4 to the level that causes the IGBT of the heater control circuit 44 to have the non-conducting state to cause the auxiliary heater 32 to be de-energized. This control may thus enable the heater current to exceed the rated current TH2.

The energization/non-energization control of the main heater 31 is controlled by the IGBT included in the heater control circuit 43. The energization/non-energization control of the auxiliary heater 32 is controlled by the IGBT included in the heater control circuit 44. In contrast to triacs, the IGBTs are capable of becoming the non-conducting state irrespective of a zero-crossing timing. In a case where a peak of alternating current that may pass through the main heater 31 or the auxiliary heater 32 that is assumed to have undergone the wave number control exceeds the rated current TH2, the use of the IGBTs may achieve the control of the first illustrative embodiment appropriately.

Alternative Example of First Illustrative Embodiment

Figure 6:
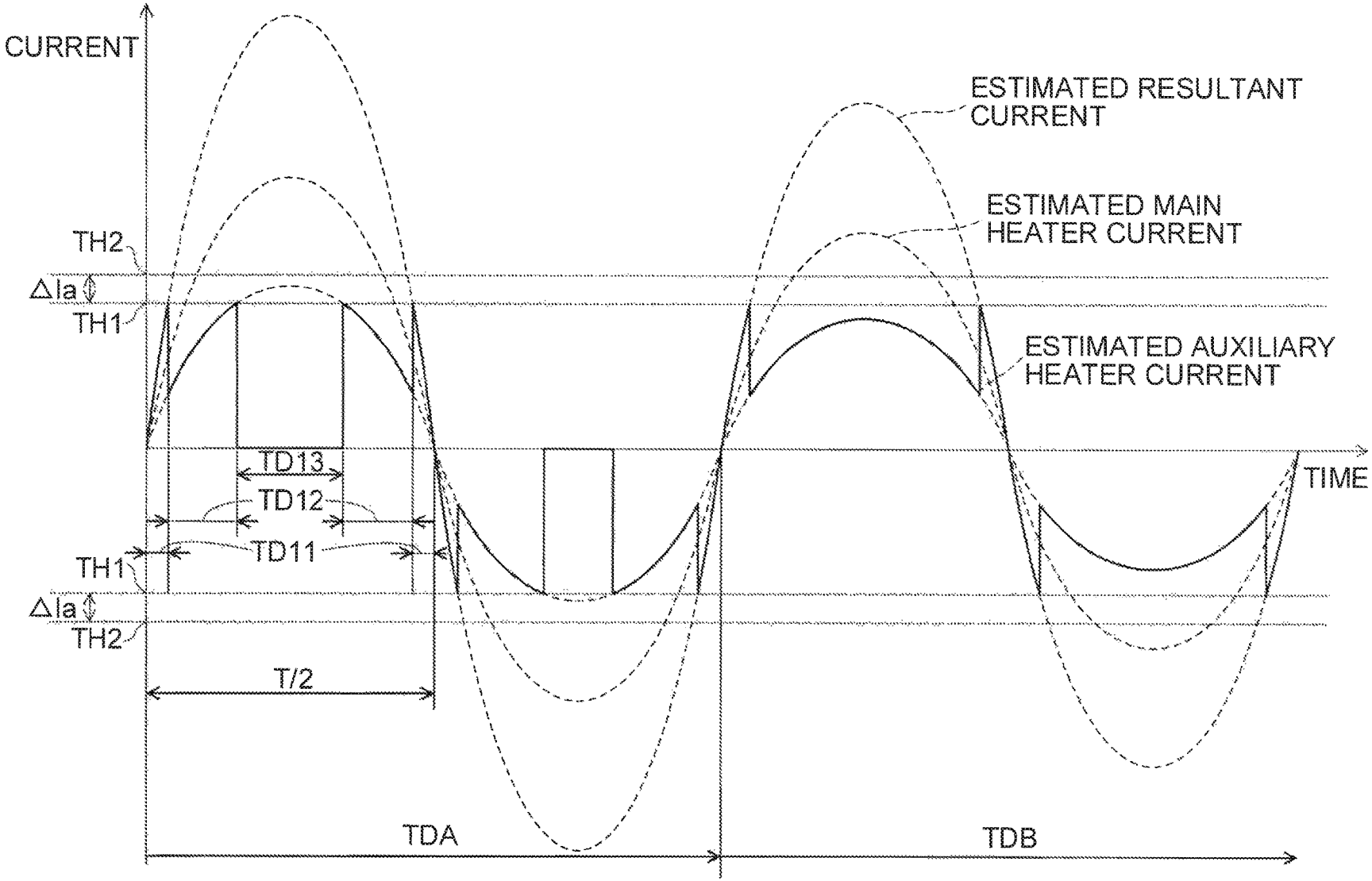
FIG. 6 is a chart showing a waveform transition during each full cycle of the heater current in the heater control processing in an alternative example of the first illustrative embodiment according to one or more aspects of the disclosure.

Referring to FIG. 6, an alternative example of the first illustrative embodiment will be described. In the above-described example of the first illustrative embodiment, in response to the resultant current reaching the threshold TH1, in step S7, the controller 33 turns the auxiliary heater 32 off. Nevertheless, in the alternative example of the first illustrative embodiment, in response to the resultant current reaching the threshold TH1, the controller 33 turns the main heater 31 off instead of the auxiliary heater 32.

More specifically, the controller 33 executes the same or similar processing in each of steps S1 to S5. If the controller 33 determines that the heater current has reached the threshold TH1 (e.g., YES in step S5), the controller 33 turns the main heater 31 off. The controller 33 stores a measured time in the memory 33A as a time period TD11. The time period TD11 corresponds to the time period from the determined zero-crossing timing to the timing at which the controller 31 turns the main heater 31 off. Subsequent to this, the controller 33 determines whether the heater current has reached the threshold TH1. If the controller 33 determines that the heater current has reached the threshold TH1, the controller 33 turns the auxiliary heater 32 off. The controller 33 stores another measured time in the memory 33A as a time period TD12. The time period TD12 corresponds to the time period from the timing at which the controller 33 turns the main heater 31 off to the timing at which the controller 33 turns the auxiliary heater 32 off. Subsequent to this, the controller 33 determines whether the auxiliary heater 32 has been turned off. If the controller 33 determines that the auxiliary heater 32 has been turned off, the controller 33 calculates a time period TD13, which is obtained by subtraction of a value which is twice the duration of the time period TD11 and a value which is twice the duration of the time period TD12 from the duration of a half cycle (T/2). In response to a time period equal to the time period TD13 elapsing since the auxiliary heater 32 is turned off, the controller 33 turns the auxiliary heater 32 on. Thereafter, in response to a time period equal to the time period TD12 elapsing since the auxiliary heater 32 is turned on, the controller 33 turns the main heater 31 off. If the controller 33 determines that the auxiliary heater 32 has not been turned off, the controller 33 calculates a time period which is obtained by subtraction of a value which is twice the duration of the time period TD11 from the duration of a half cycle (T/2). In response to a time period equal to the obtained time period elapsing since the main heater 31 is turned off, the controller 33 turns the main heater 31 on.

In FIG. 6, a waveform transition during a period TDA shows a transition pattern in a case where the auxiliary heater 32 is turned on and off during each half cycle. A waveform transition during a period TDB shows a transition pattern in a case where the auxiliary heater 32 stays on continuously during each half cycle. As illustrated in the period TDB, the heater current becomes lower in response to increase of the resistance of the auxiliary heater 32 due to a long duration of energization of the auxiliary heater 32. In a case where such a phenomenon occurs while only the sub heater 32 is energized, the auxiliary heater 32 does not need to be turned off and the controller 33 thus leaves the auxiliary heater 32 to be energized.

In this example, the main heater 31 is an example of the first heater. The auxiliary heater 32 is an example of the second heater. The IGBT of the heater control circuit 43 is an example of the first switch. The IGBT of the heater control circuit 44 is an example of the second switch. The threshold TH1 is an example of the first value. The rated current TH2 is an example of the second value.

According to the alternative example of the first illustrative embodiment, the example control may enable both of the main heater 31 and the auxiliary heater 32 to be energized during a particular period before the heater current reaches the rated current TH2. In addition, the example control may enable the auxiliary heater 32 to stay energized until the heater current reaches the threshold TH1. Such a control may enable quick temperature to rise at the main heater 31 and the auxiliary heater 32 while saving power to be supplied to the main heater 31 and the auxiliary heater 32, thereby shortening FPOT.

Second Illustrative Embodiment

Figure 7:
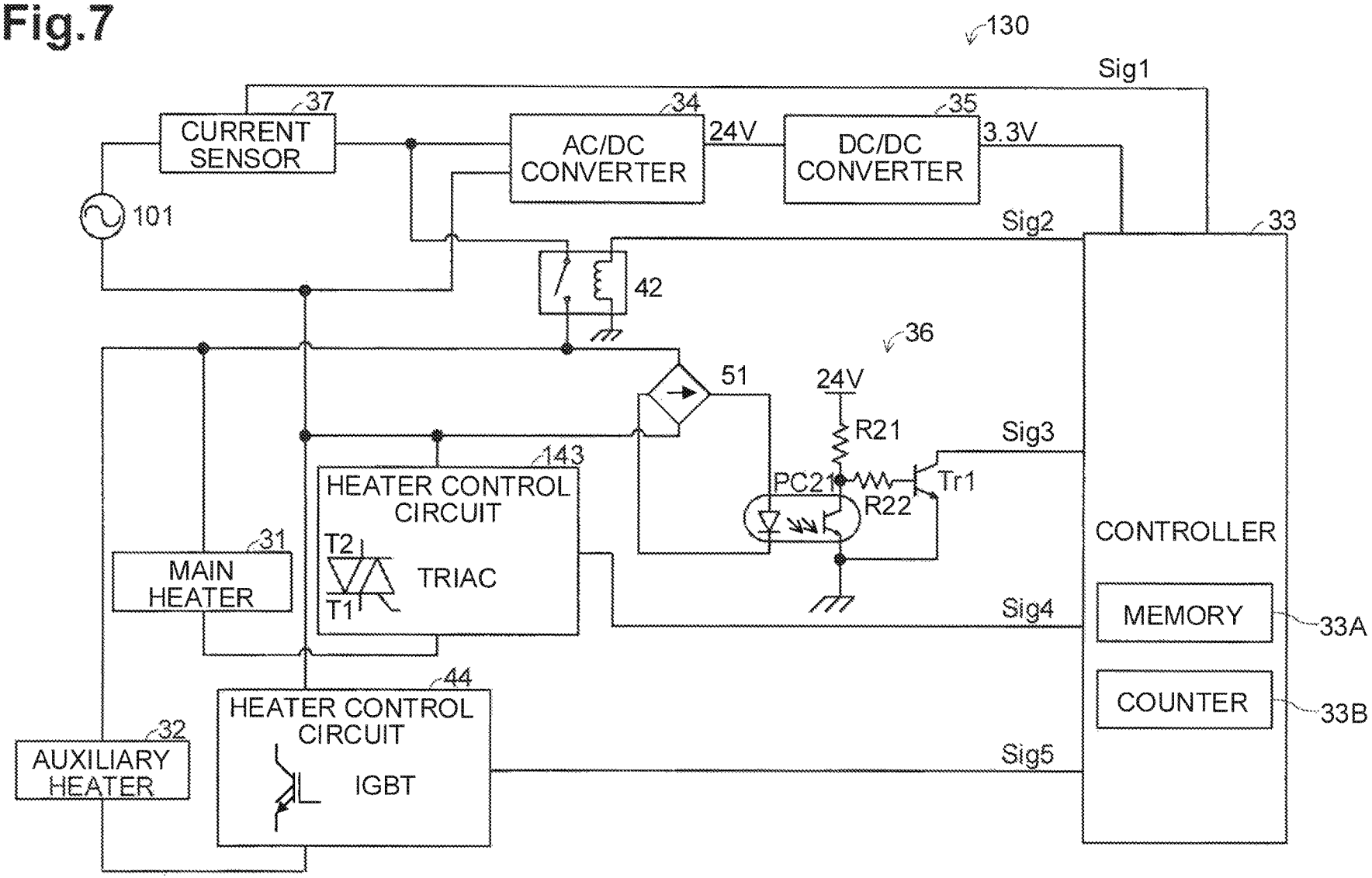
FIG. 7 is a circuit diagram of a heating system in a second illustrative embodiment according to one or more aspects of the disclosure.
Figure 8:
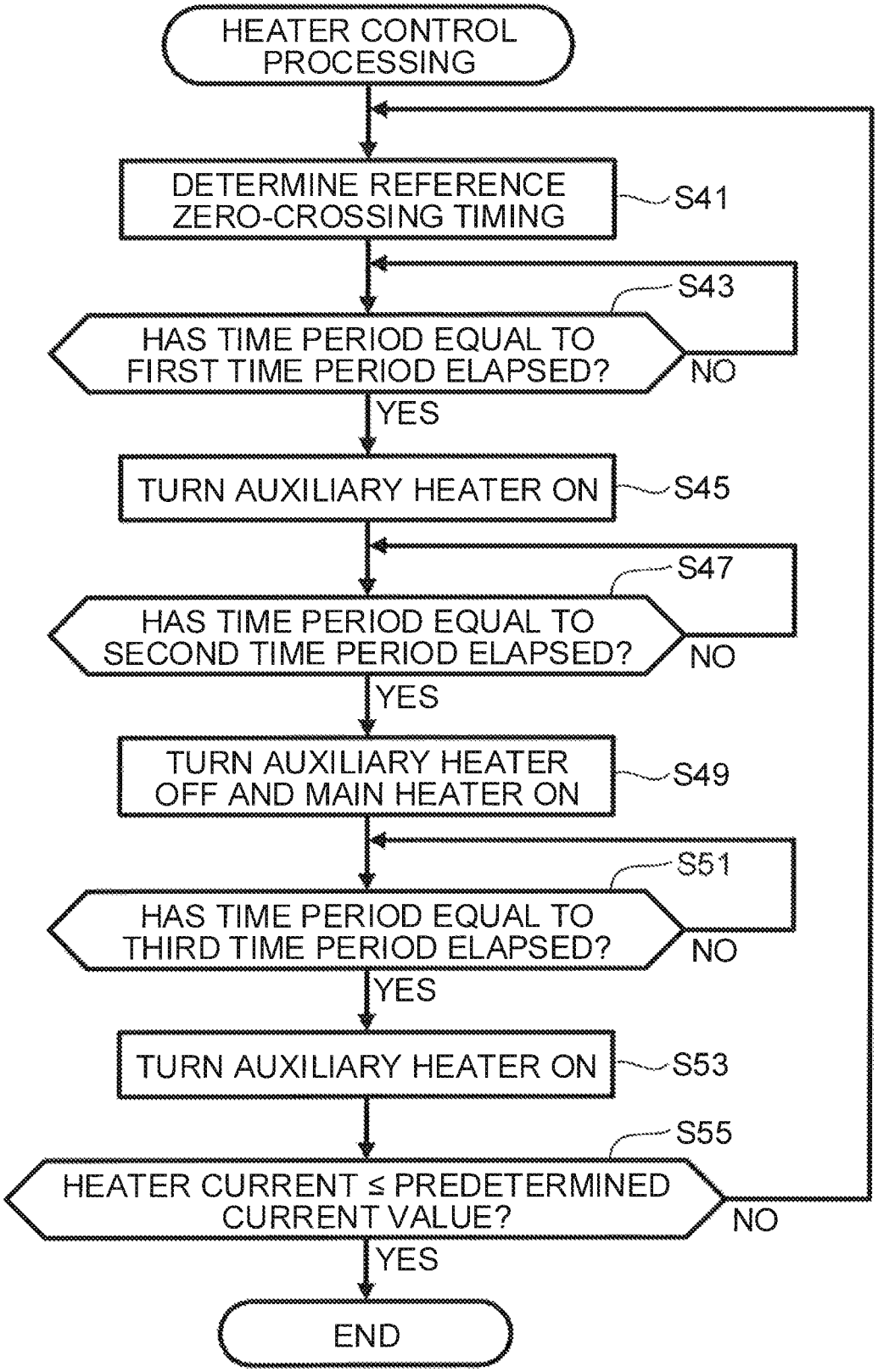
FIG. 8 is a flowchart of heater control processing in the second illustrative embodiment according to one or more aspects of the disclosure.
Figure 9:
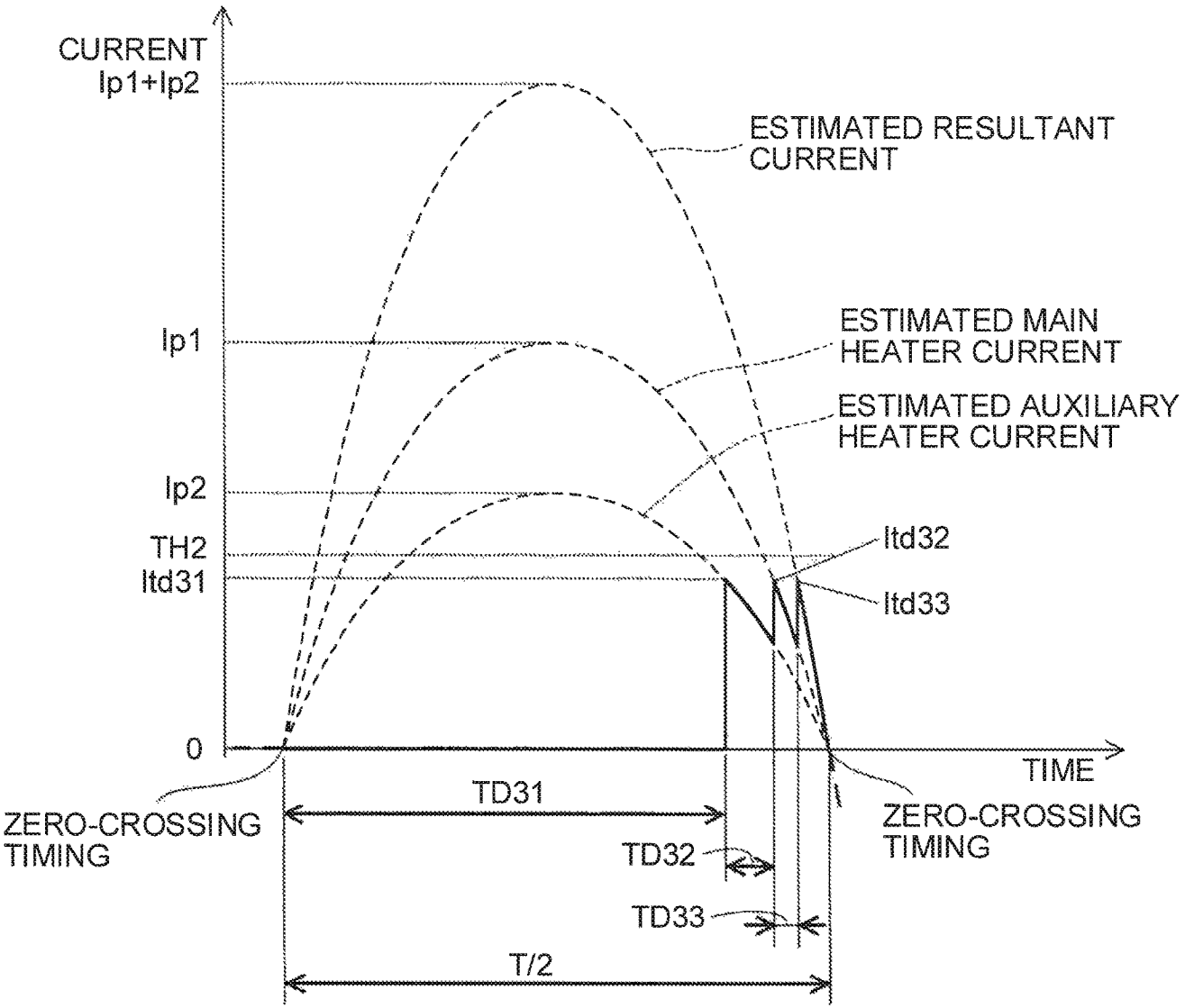
FIG. 9 is a chart showing a waveform transition during a half cycle of heater current in the heater control processing in the second illustrative embodiment according to one or more aspects of the disclosure.

Referring to FIGS. 7, 8, and 9, a second illustrative embodiment will be described. A heating system 130 of the second illustrative embodiment includes a heater control circuit 143 having a different configuration from the heating system 30 of the first illustrative embodiment. The heater control circuit 143 is configured to control the main heater 31. In the second illustrative embodiment, an explanation will be given mainly for the parts different from the first illustrative embodiment, and an explanation will be omitted for the common components by assigning the same reference numerals thereto.

As illustrated in FIG. 7, the heater control circuit 143 includes a triac. The triac has a T1 terminal connected to one of poles of the AC supply 101, and a T2 terminal connected to the other of the poles of the AC supply 101 via the main heater 31 and the relay 42. The heater control circuit 143 receives a signal Sig4 outputted by the controller 33. The heater control circuit 143 changes the state of the triac to cause the main heater 31 to be energized or de-energized in accordance with the level of the signal Sig4. More specifically, for energizing the main heater 31, the controller 33 outputs a signal Sig4 (e.g., a pulse signal) to the heater control circuit 143. In response to the heater control circuit 143 receiving the signal Sig4, the triac of the heater control circuit 143 turns on, which causes the main heater 31 to be energized. In response to the triac turning off at a zero-crossing timing, the main heater 31 becomes de-energized.

In response to, for example, turning-on of the printer 1, the controller 33 starts heater control processing (refer to FIG. 8). In response to the turning-on of the printer 1, the controller 33 changes the signal Sig2 to the level that causes the contact of the relay 42 to be closed.

The controller 33 determines a reference zero-crossing timing (e.g., step S41). In response to this, the controller 33 causes the counter 33B to start measuring time. Subsequent to step S41, the controller 33 determines, based on the time being measured by the counter 33B, whether a time period equal to a time period TD31 prestored in the memory 33A has elapsed from the zero-crossing timing (e.g., step S43). The time period TD31 corresponds to a time period relative to a phase angle obtained in advance, for example, by experiment such that the heater current stays below the rated current TH2 (e.g., the upper limit) when only the auxiliary heater 32 becomes energized under the worst condition that may correspond to a timing at which the heater current flowing reaches its peak. The worst condition includes, for example, a timing at which the resistance of the auxiliary heater 32 becomes minimum. If the controller 33 determines that a time period equal to the time period TD31 has not elapsed yet (e.g., NO in step S43), the routine returns to step S43. The controller 33 repeats the processing of step S43 until the controller 33 makes a positive determination (e.g., "YES") in step S43. If the controller 33 determines that a time period equal to the time period TD31 has elapsed (e.g., YES in step S43), the controller 33 turns the auxiliary heater 32 on and causes the counter 33B to stop measuring time. Further, the controller 33 causes the counter 33B to reset and newly start measuring time (e.g., step S45). Subsequent to step S45, the controller 33 determines, based on the time being measured by the counter 33B, whether a time period equal to a time period TD32 prestored in the memory 33A has elapsed from the start of the processing of step S45 (e.g., step S47). The time period TD32 corresponds to a time period relative to a phase angle obtained in advance, for example, by experiment such that the heater current stays below the rated current TH2 when only the main heater 31 becomes energized under the worst condition. If the controller 33 determines that a time period equal to the time period TD32 has not elapsed yet (e.g., NO in step S47), the routine returns to step S47. The controller 33 repeats the processing of step S47 until the controller 33 makes a positive determination (e.g., "YES") in step S47. If the controller 33 determines that a time period equal to the time period TD32 has elapsed (e.g., YES in step S47), the controller 33 turns the auxiliary heater 32 off and the main heater 32 on and causes the counter 33B to stop measuring time. Further, the controller 33 causes the counter 33B to reset and newly start measuring time (e.g., step S49).

Subsequent to step S49, the controller 33 determines, based on the time being measured by the counter 33B, whether a time period equal to a time period TD33 prestored in the memory 33A has elapsed from the start of the processing of step S49 (e.g., step S51). The time period TD33 corresponds to a time period relative to a phase angle obtained in advance, for example, by experiment such that the heater current stays below the rated current TH2 when both the main heater 31 and the auxiliary heater 32 become energized under the worst condition. If the controller 33 determines that a time period equal to the time period TD33 has not elapsed yet (e.g., NO in step S51), the routine returns to step S51. The controller 33 repeats the processing of step S51 until the controller 33 makes a positive determination (e.g., "YES") in step S51. If the controller 33 determines that a time period equal to the time period TD33 has elapsed (e.g., YES in step S51), the controller 33 turns the auxiliary heater 32 on (e.g., step S53). Subsequent to step S53, the controller 33 determines whether the heater current detected based on a currently input signal Sig1 is smaller than or equal to a predetermined current value prestored in the memory 33A (e.g., step S55). The predetermined current value may be obtained in advance, for example, by experiment. The predetermined current may have a peak of the resultant current that stays below the rated current TH2. The resultant current may be a combined current of the current that passes through the main heater 31 that is assumed to have undergone the wave number control and the current that passes through the auxiliary heater 32 that is assumed to have undergone the wave number control. If the controller 33 determines that the heater current detected based on the signal Sig1 is not smaller than or equal to the predetermined current value (e.g., NO in step S55), the routine returns to step S41. If the controller 33 determines that the heater current detected based on the signal Sig1 is smaller than or equal to the predetermined current value (e.g., YES in step S55), the controller 33 ends the heater control processing.

As illustrated in FIG. 9, in response to a time period equal to the time period TD31 elapsing from the determined zero-crossing timing, the auxiliary heater 32 is turned on. In response to a time period equal to the time period TD32 elapsing since the auxiliary heater 32 is turned on, the auxiliary heater 32 is turned off and the main heater 31 is turned on. In response to a time period equal to the time period TD33 elapsing since the auxiliary heater 32 is turned off and the main heater 31 is turned on, the auxiliary heater 32 is turned on. Each timing at which a respective heater is turned on is determined in advance such that the heater current stays below the rated current TH2. Using such a timing may thus enable each heater to be turned on while the heater current is below the rated current TH2. Reference numerals Ip1, Ip2, Itd31, Itd32, and Itd33 in FIG. 9 will be referred to the later explanation (e.g., a third illustrative embodiment).

In this example, the triac of the heater control circuit 143 is an example of the second switch. The timing at which the time period TD31 elapses from the zero-crossing timing is an example of a first timing. The timing at which the time period TD32 elapses from the execution of the processing of step S45 is an example of a second timing and an example of a third timing. The timing at which the time period TD33 elapses from the execution of the processing step S49 is an example of a fourth timing.

The second illustrative embodiment may achieve effects as follows. In step S45, the controller 33 turns the auxiliary heater 32 on at the timing at which the heater current flowing when only the auxiliary heater 32 becomes energized is below or equal to the rated current TH2. In step S49, the controller 33 turns the auxiliary heater 32 off and the main heater 31 on at the timing at which the heater current flowing when only the main heater 32 becomes energized is below or equal to the rated current TH2. In step S53, the controller 33 turns the auxiliary heater 32 on at the timing at which the heater current flowing when both the main heater 31 and the auxiliary heater 32 become energized is below or equal to the rated current TH2. Such a control may thus provide the period in which only the auxiliary heater 32 is energized, the period in which only the main heater 31 is energized, and the period in which both the main heater 31 and the auxiliary heater 32 are energized. Consequently, while saving power to be supplied to the main heater 31 and the auxiliary heater 32, such a control may enable quick temperature to rise at the main heater 31 and the auxiliary heater 32, thereby shortening FPOT. As compared with a configuration in which the controller 33 may turn the auxiliary heater 32 on at the timing at which the time period TD31 elapses from the zero-crossing timing and then turn the main heater 31 on at the timing at which the time period TD33 elapses from the execution of the processing step S49, the configuration according to the second illustrative embodiment may shorten FPOT more and reduce or prevent the heater current from exceeding the rated current TH2. As compared with a configuration in which the controller 33 may turn the main heater 31 on at the timing at which the time period obtained by addition of the time period TD31 and the time period TD32 elapses from the zero-crossing timing and then turn the auxiliary heater 32 on at the timing at which the time period TD33 elapses from the execution of the processing step S49, the configuration according to the second illustrative embodiment may shorten FPOT more and reduce or prevent the heater current from exceeding the rated current TH2.

In step S49, the controller 33 turns the auxiliary heater 32 off and the main heater 31 on. This control may thus enable the main heater 31 to be tuned on at an earlier timing as compared with a case where the controller 33 turns on the main heater 31 after turning the auxiliary heater 32 off.

The energization/non-energization control of the main heater 31 is controlled by the triac included in the heater control circuit 143. The energization/non-energization control of the auxiliary heater 32 is controlled by the IGBT included in the heater control circuit 44. While the main heater 31 is turned on in step S49 and stays energized until the next zero-crossing timing occurs, the auxiliary heater 32 is turned on in step S45 and is turned off in step S49. The use of the triac in the heater control circuit 143 for the main heater 31 and the IGBT in the heater control circuit 44 for the auxiliary heater 32 may achieve the control of the second illustrative embodiment appropriately.

First Alternative Example of Second Illustrative Embodiment

Figure 10:
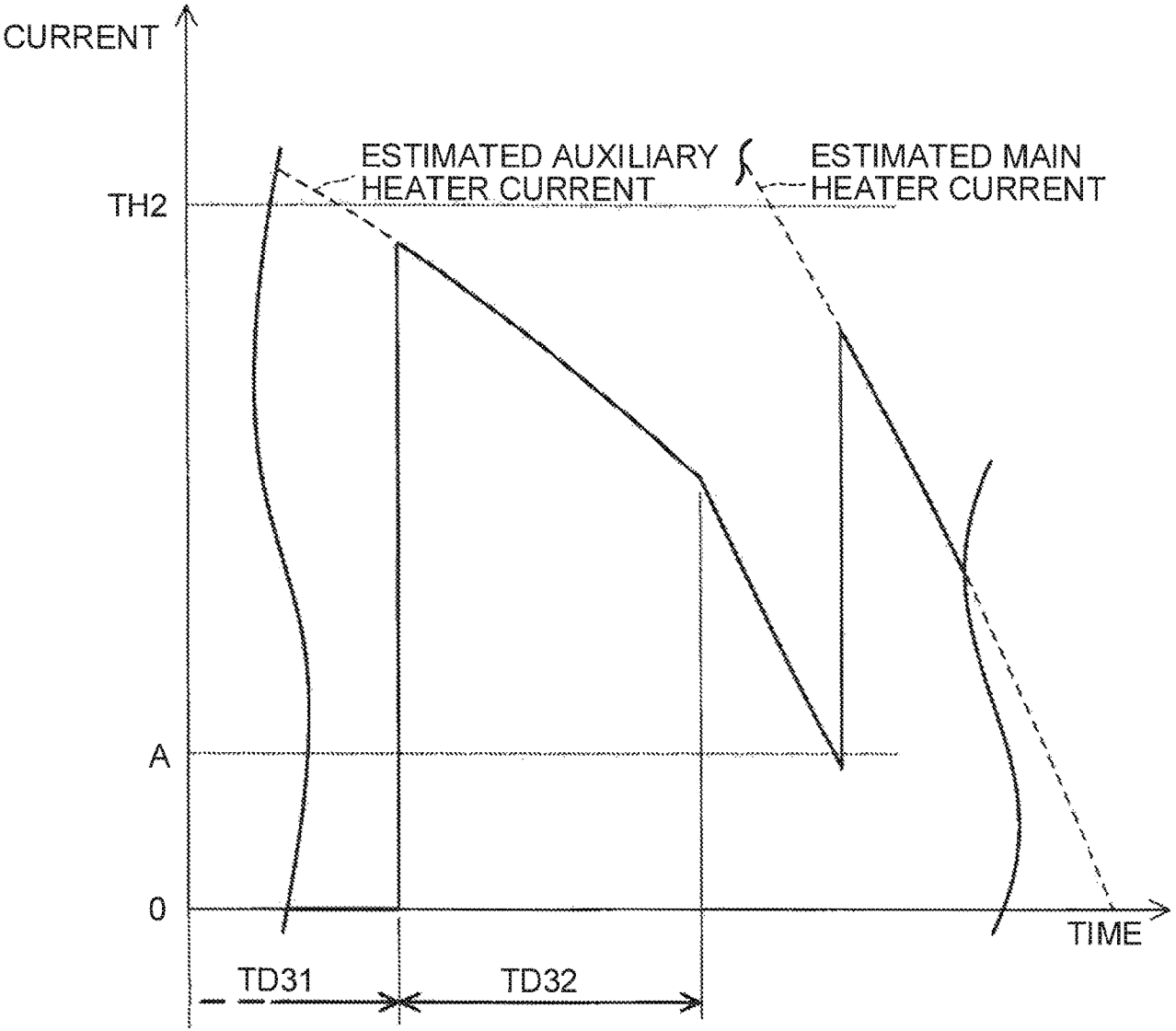
FIG. 10 is a chart showing a waveform transition of the heater current from a timing at which an auxiliary heater is turned off to a timing at which a main heater is turned on in a first alternative example of the second illustrative embodiment.
Figure 11:
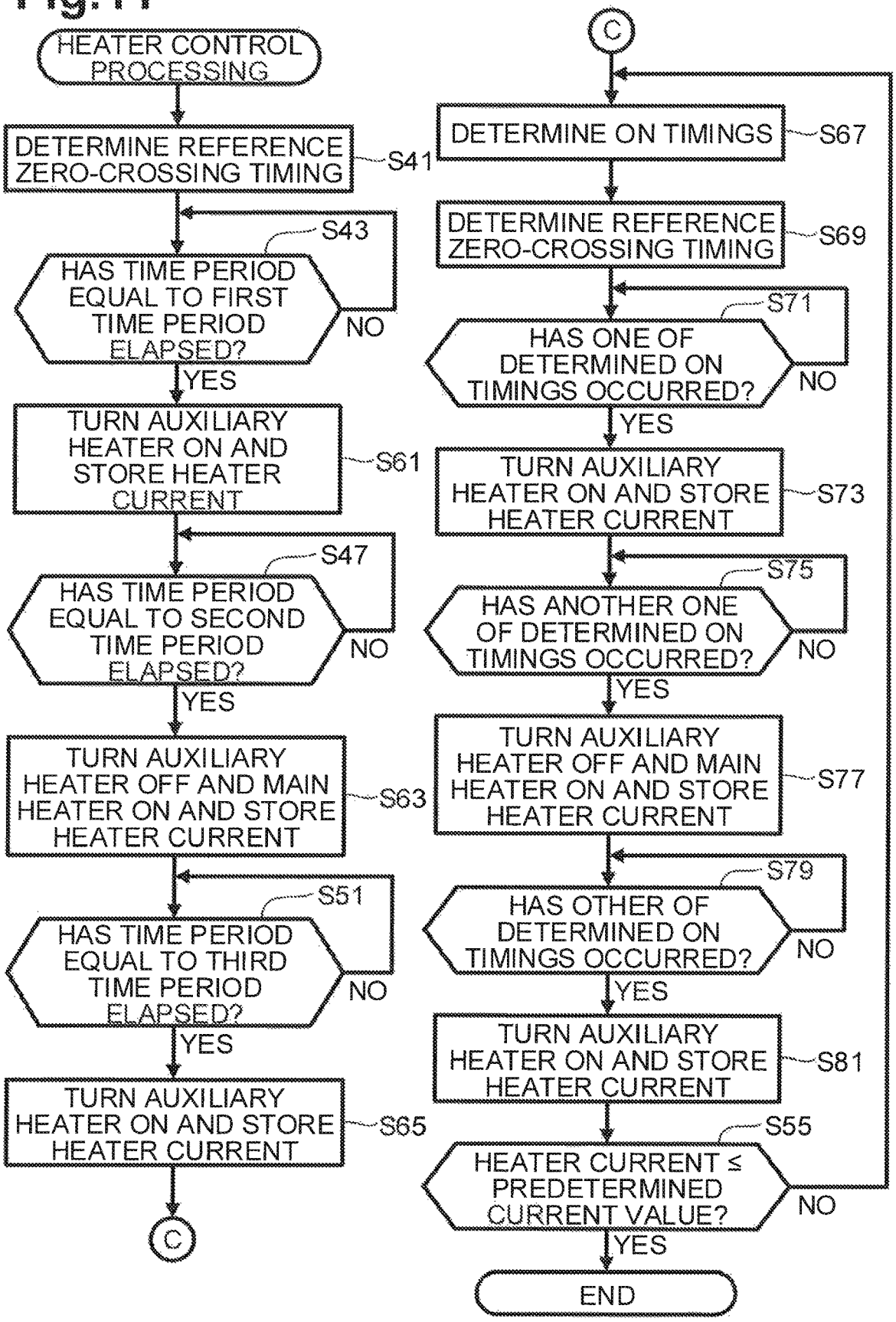
FIG. 11 is a flowchart of heater control processing in a third illustrative embodiment according to one or more aspects of the disclosure.

Referring to FIG. 10, a first alternative example of the second illustrative embodiment will be described. In the above-described example of the second illustrative embodiment, in step S49, the controller 33 turns the auxiliary heater 32 off and the main heater 31 on at the same timing. Nevertheless, in the first alternative example of the second illustrative embodiment, the controller 33 turns the main heater 31 on at a particular timing (e.g., the third timing) after the timing at which the controller 33 turns the auxiliary heater 32 off (e.g., the second timing). The controller 33 determines a timing for turning the main heater 31 on using a reference A (e.g., a predetermined value). The reference A may be smaller than the rated current TH2.

More specifically, if the controller 33 makes a positive determination (e.g., "YES") in step S47, i.e., if the controller determines that a time period equal to the time period TD32 has elapsed, the controller 33 turns the auxiliary heater 32 off. The heater current thus becomes lower. If the controller 33 determines that the heater current detected based on the currently input signal Sig1 is smaller than or equal to the reference value A, the controller 33 turns the main heater 31 on. In this example, the controller 33 turns the main heater 31 on after the heater current becomes smaller than or equal to the reference A that may be smaller than the rated current TH2. Such a control may thus reduce or prevent the heater current from exceeding the rated current TH2 when the controller 33 turns the main heater 31 on.

Second Alternative Example of Second Illustrative Embodiment

A second alternative example of the second illustrative embodiment will be described. In the first alternative example of the second illustrative embodiment, if the controller 33 determines that the heater current detected based on the currently input signal Sig1 is smaller than or equal to the reference A, the controller 33 turns the main heater 31 on. Nevertheless, in the second alternative example of the second illustrative embodiment, the controller 33 turns the auxiliary heater 32 off at the timing at which a time period equal to the time period TD32 has elapsed from the start of the processing of step S45, and turns the main heater 31 on at a particular timing at which a predetermined time period has elapsed from the turning-off of the auxiliary heater 32. The time period TD32 corresponds to a time period in which the heater current stays below the rated current TH2 when only the main heater 31 becomes energized under the worst condition. In this example, in response to turning the main heater 31 on at the particular timing at which the predetermined time period has elapsed from the end of the time period TD32, such a control may thus reduce or prevent the heater current from exceeding the rated current TH2.

Third Illustrative Embodiment

Hereinafter, heater control processing according to a third illustrative embodiment will be described. The heating system 130 of the third illustrative embodiment has the same or similar configuration to the heating system 130 of the second illustrative embodiment, and therefore, a detailed explanation of the heating system 130 will be omitted. Heater control processing of the third illustrative embodiment may include the same or similar processing as the heater control processing of the second illustrative embodiment, and therefore, an explanation will be omitted for each common processing by assigning the same step number thereto.

The controller 33 determines a reference zero-crossing timing (e.g., step S41). In response to this, the controller 33 causes the counter 33B to start measuring time. Subsequent to step S41, the controller 33 determines, based on the time being measured by the counter 33B, whether a time period equal to a time period TD31 prestored in the memory 33A has elapsed from the zero-crossing timing (e.g., step S43). If the controller 33 determines that a time period equal to the time period TD31 has not elapsed yet (e.g., NO in step S43), the routine returns to step S43. The controller 33 repeats the processing of step S43 until the controller 33 makes a positive determination (e.g., "YES") in step S43. If the controller 33 determines that a time period equal to the time period TD31 has elapsed (e.g., YES in step S43), the controller 33 turns the auxiliary heater 32 on, and stores the heater current detected based on the signal Sig1 in the memory 33A. Further, the controller 33 causes the counter 33B to stop measuring time, and causes the counter 33B to reset and newly start measuring time (e.g., step S61). Subsequent to step S45, the controller 33 determines, based on the time being measured by the counter 33B, whether a time period equal to a time period TD32 prestored in the memory 33A has elapsed from the start of the processing of step S45 (e.g., step S47). If the controller 33 determines that a time period equal to the time period TD32 has not elapsed yet (e.g., NO in step S47), the routine returns to step S47. The controller 33 repeats the processing of step S47 until the controller 33 makes a positive determination (e.g., "YES") in step S47. If the controller 33 determines that a time period equal to the time period TD32 has elapsed (e.g., YES in step S47), the controller 33 turns the auxiliary heater 32 off and the main heater 31 on, and stores the heater current detected based on the signal Sig1 in the memory 33A. Further, the controller 33 causes the counter 33B to stop measuring time, and causes the counter 33B to newly reset and start measuring time (e.g., step S63).

Subsequent to step S63, the controller 33 determines, based on the time being measured by the counter 33B, whether a time period equal to a time period TD33 prestored in the memory 33A has elapsed from the start of the processing of step S49 (e.g., step S51). If the controller 33 determines that a time period equal to the time period TD33 has not elapsed yet (e.g., NO in step S51), the routine returns to step S51. The controller 33 repeats the processing of step S51 until the controller 33 makes a positive determination (e.g., "YES") in step S51. If the controller 33 determines that a time period equal to the time period TD33 has elapsed (e.g., YES in step S51), the controller 33 turns the auxiliary heater 32 on and stores the heater current detected based on the signal Sig1 in the memory 33A (e.g., step S65). Subsequent to step S65, the controller 33 determines, based on the latest detected currents stored in the memory 33A in the respective steps S61, S63, and S65, a timing for turning the auxiliary heater 32 on, a timing for turning the main heater 31 on, and another timing for turning the auxiliary heater 32 on, respectively, during the next half cycle (e.g., step S67). The timing for turning a respective heater on may also be referred to as the "ON timing".

Referring to FIG. 9, the timing determination executed in step S67 will be described. A timing for turning the auxiliary heater 32 on first time after a reference zero-crossing timing occurs is determined as described below. Here, a timing at which the heater current reaches the rated current TH2 when only the auxiliary heater 32 becomes energized is determined. Assuming that Itd31 indicates the heater current detected in step S61 and Ip2 indicates an estimated peak current of the auxiliary heater 32, the current Itd31 is expressed by Equation 1 using time period T and the time period TD31. The estimated peak current indicates a peak of the heater current that is assumed to have undergone the wave number control during a half cycle. More specifically, for example, the estimated peak current may be the heater current having a phase angle of $\pi/2$ radians or having a phase angle of $3\pi/2$ radians.

$$Itd31=Ip2*\sin(2\pi*(T/2-TD31)/T); \quad \text{Equation 1}$$

Equation 1 is transformed into Equation 2.

$$Ip2=Itd31/(\sin(2\pi*(T/2-TD31)/T)); \quad \text{Equation 2}$$

For obtaining time required for the heater current to reach the rated current TH2, Equation 3 may be used, where time required for the heater current to reach the rated current TH2 from a reference zero-crossing timing is expressed by TDx1.

$$TH2=Ip2*\sin(2\pi*(T/2-TDx1)/T); \quad \text{Equation 3}$$

Equation 3 is arranged to Equation 4 below.

$$TDx1=T/2-\arcsin(TH2/Ip2)*T/(2\pi); \quad \text{Equation 4}$$

In step S67, the time period TDx1 is obtained by substitution of Equation 2 into Ip2 of Equation 4. Thus, the timing for turning the auxiliary heater 32 on may be obtained.

The similar calculation may be applied for obtaining a timing for turning the main heater 31 on, and another timing for turning the auxiliary heater 32 on while the main heater 31 stays on. Assuming that Itd32 indicates the current detected in step S63 and Ip1 indicates an estimated peak current of the main heater 31, the estimated peak current Ip1 may be obtained by Equation 5 and a time period TDx2 for the heater current to reach the rated current TH2 from the zero-crossing timing may be obtained by Equation 6. Ip1=Itd32/(sin(2π*(T/2−TD32)/T)); Equation 5

$$TDx2=T/2-\arcsin(TH2/Ip1)*T/(2\pi); \quad \text{Equation 6}$$

In step S67, the time period TDx2 is obtained by substitution of Equation 5 into Ip1 of Equation 6. Thus, the timing for turning the main heater 31 on may be obtained.

Assuming that Itd33 indicates the current detected in step S65, an estimated resultant peak current (Ip1+Ip2) of the estimated peak current Ip1 and the estimated peak current Ip2 may be obtained by Equation 7 and a time period TDx3 for the heater current to reach the rated current TH2 from the reference zero-crossing timing may be obtained by Equation 8.

$$Ip1+Ip2=Itd33/(\sin(2\pi*(T/2-TD33)/T)); \quad \text{Equation 7}$$

$$TDx3=T/2-\text{arc}\sin(TH2/(Ip1+Ip2)*T/(2\pi); \quad \text{Equation 8}$$

In step S67, the time period TDx3 is obtained by substitution of Equation 7 into (Ip1+Ip2) of Equation 8. Thus, the timing for turning the auxiliary heater 32 on while the main heater 31 stays on may be obtained. The controller 33 stores, in the memory 33A, the time period TDx1, the time period TDx2, and the time period TDx3 each obtained in step S67. The timing at which the time period TDx1 ends, the timing at which the time period TDx2 ends, and the timing at which the time period TDx3 ends are each referred to as an ON timing.

The controller 33 determines a reference zero-crossing timing (e.g., step S69). In response to this, the controller 33 causes the counter 33B to start measuring time. Subsequent to step S67, the controller 33 determines, based on the time being measured by the counter 33B, whether one of the ON timings determined in step S67 has occurred (e.g., step S71). More specifically, for example, the controller 33 determines whether a time period equal to the time period TDx1 has elapsed. If the controller 33 determines that a time period equal to the time period TDx1 has elapsed, the controller 33 determines that one of the ON timings determined in step S67 has occurred. If the controller 33 determines that one of the determined ON timings has not occurred (e.g., NO in step S71), the routine returns to step S71. If the controller 33 determines that one of the determined ON timings has occurred (e.g., YES in step S71), the controller 33 turns the auxiliary heater 32 on and stores the heater current detected based on the signal Sig1 in the memory 33A. Further, the controller 33 causes the counter 33B to stop measuring time, and causes the counter 33B to reset and newly start measuring time (e.g., step S73). Subsequent to step S73, the controller 33 determines, based on the time being measured by the counter 33B, whether another one of the ON timings determined in step S67 has occurred (e.g., step S75). More specifically, for example, the controller 33 determines whether a time period equal to the time period TDx2 has elapsed. If the controller 33 determines that a time period equal to the time period TDx2 has elapsed, the controller 33 determines that another one of the ON timings determined in step S67 has occurred. If the controller 33 determines that another one of the determined ON timings has not occurred (e.g., NO in step S75), the routine returns to step S75. If the controller 33 determines that another one of the determined ON timings has occurred (e.g., YES in step S75), the controller 33 turns the auxiliary heater 32 off and the main heater 31 on and stores the heater current detected based on the signal Sig1 in the memory 33A. Further, the controller 33 causes the counter 33B to stop measuring time, and causes the counter 33B to reset and newly start measuring time (e.g., step S77).

Subsequent to step S77, the controller 33 determines, based on the time being measured by the counter 33B, whether the other of the ON timings determined in step S67 has occurred (e.g., step S79). More specifically, for example, the controller 33 determines whether a time period equal to the time period TDx3 has elapsed. If the controller 33 determines that a time period equal to the time period TDx3 has elapsed, the controller 33 determines that the other of the ON timings determined in step S67 has occurred. If the controller 33 determines that the other of the determined ON timings has not occurred (e.g., NO in step S79), the routine returns to step S79. If the controller 33 determines that the other of the determined ON timings has occurred (e.g., YES in step S79), the controller 33 turns the auxiliary heater 32 on and stores the heater current detected based on the signal Sig1 in the memory 33A (e.g., step S81). Subsequent to step S81, the controller 33 executes the heater current is smaller than or equal to the predetermined current value (e.g., step S55). If the controller 33 makes a negative determination (e.g., "NO") in step S55, the routine returns to step S67. If the controller 33 makes a positive determination (e.g., "YES") in step S55, the controller 33 ends the heater control processing. As described above, in the heater control processing of the third illustrative embodiment, the main heater 31 and the auxiliary heater 32 are each turned on at the respective different ON timings that are determined such that the heater current stays below the rated current TH2. This may thus enable the main heater 31 and the auxiliary heater 32 to be turned on at each earlier timing.

In this example, the current sensor 37 is an example of each of a first current sensor, a second current sensor, and a third current sensor.

The third illustrative embodiment may thus achieve effects as follows.

In step S67, the controller 33 determines the timing at which the heater current that flows when only the auxiliary heater 32 becomes energized reaches the rated current TH2. In step S73, the controller 33 turns the auxiliary heater 32 on at the timing determined in step S67. Such a control may thus enable the auxiliary heater 32 to become energized at an earlier timing without the heater current exceeding the rated current TH2.

In step S67, the controller 33 further determines the timing at which the heater current that flows when only the main heater 31 becomes energized reaches the rated current TH2. In step S77, the controller 33 turns the main heater 31 on at the timing determined in step S67. Such a control may thus enable the main heater 31 to become energized at an earlier timing without the heater current exceeding the rated current TH2.

In step S67, the controller 33 further determines the timing at which the heater current that flows when the main hater 31 and the auxiliary heater 32 become energized reaches the rated current TH2. In step S81, the controller 33 turns the auxiliary heater 32 on at the timing determined in step S67. Such a control may thus enable the main heater 31 and the auxiliary heater 32 to become energized at respective earlier timings without the heater current exceeding the rated current TH2.

Alternative Example of Third Illustrative Embodiment an Alternative Example of the Third Illustrative Embodiment Will be Described.

In the example of the third illustrative embodiment, for, in step S67, determining the timing for turning the auxiliary heater 32 on while the main heater 31 stays on, the heater current detected in step S65 based on the currently input signal Sig1 is used. Nevertheless, in the alternative example of the third illustrative embodiment, for example, the timing for turning the auxiliary heater 32 on while the main heater 31 stays on may be determined based on both the heater current detected in step S61 and the heater current detected in step S63. More specifically, for example, the estimated peak current Ip1 is expressed by Equation 2 and the estimated peak current Ip2 is expressed by Equation 5. Thus, the time period TDx3 is obtained by substitution of Equation 2 and Equation 5 into Equation 8. Such a configuration may therefore obtain the time period TDx3 with omission of the processing of step S65 for detecting the heater current based on the currently input signal Sig1. According to the alternative example of the third illustrative embodiment, the controller 33 turns the auxiliary heater 32 on at the determined ON timing. Such a control may thus enable the main heater 31 and the auxiliary heater 32 to become energized at their respective earlier timings without the heater current exceeding the rated current TH2.

While the disclosure has been described in detail with reference to the specific embodiment thereof, these are merely examples, and various changes, arrangements and modifications may be applied therein without departing from the spirit and scope of the disclosure. In the example of the first illustrative embodiment, the main heater 31 and the auxiliary heater 32 are turned on at the respective timings in each of a first half and a second half of each half cycle. Nevertheless, in other embodiments, for example, the main heater 31 and the auxiliary heater 32 may be turned on at the respective timing in the first half of each half cycle only.

In the example of the first illustrative embodiment, in response to determining a reference zero-crossing timing in step S1, the controller 33 turns both of the main heater 31 and the auxiliary heater 32 on in step S3. Nevertheless, in other embodiments, for example, the controller 33 may turn at least one of the main heater 31 and the auxiliary heater 32 on at a particular timing after the reference zero-crossing timing occurs. In still other embodiments, the controller 33 may turn the main heater 31 and the auxiliary heater 32 at respective different timings. In the example of the first illustrative embodiment, the controller 33 turns the auxiliary heater 32 off and the main heater 31 on in a single step (e.g., step S25). Nevertheless, in other embodiments, for example, the controller 33 may turn the auxiliary heater 32 in one step and may turn the main heater 31 on in another step.

In the example of the first illustrative embodiment, in each of steps S5, S9, and S13, the controller 33 makes a determination using the same threshold TH1. Nevertheless, in other embodiments, for example, in each of steps S5, S9, and S13, the controller 33 may make such a determination using respective different thresholds. In such a case, each threshold used in a corresponding one of steps S5, S9, and S13 may have a value within a predetermined range similar to the example of the first illustrative embodiment in which the threshold TH1 is included within the current range ΔIa (refer to FIG. 6).

In the example of the first illustrative embodiment, in response to the heater current reaching the threshold TH1, the controller 33 turns only the auxiliary heater 32 off in step S7. Nevertheless, in other embodiments, for example, the controller 33 may turn both of the auxiliary heater 32 and the main heater 31 off in step S7.

In the example of the first illustrative embodiment, in response to the heater current reaching the threshold TH1, in step S11, the controller 33 turns the main heater 31 off. Nevertheless, in other embodiments, for example, the controller 33 may turn the main heater 31 off at a particular timing predetermined such that the heater current stays below the rated current TH2. The same may be applied to the processing of step S15.

In the example of the first illustrative embodiment, in step S11, the controller 33 turns the auxiliary heater 32 on. Nevertheless, in other embodiments, for example, in step S11, the controller 33 might not necessarily turn the auxiliary heater 32 on.

In the example of the first illustrative embodiment, in step S67, the controller 33 determines the ON timings to be used in steps S73, S77, and S81, respectively. Nevertheless, in other embodiments, for example, in step S67, the controller 33 may determine at least one of the ON timings to be used in steps S73, S77, and S81. For example, in a case where the controller 33 determines the ON timing to be used in step S73 only, a current sensor may be disposed at a position where the current sensor can detect current that passes through the auxiliary heater 32 only. For example, in another case where the controller 33 determines the ON timing to be used in step S77 only, a current sensor may be disposed at a position where the current sensor can detect current that passes through the main heater 31 only.

In the example of the third illustrative embodiment, if the controller 33 makes a negative determination (e.g., "NO") in step S55, the routine returns to step S67. That is, the controller 33 repeats the processing of steps S67 to S81 every half cycle. Nevertheless, in other embodiments, for example, the controller 33 may execute the processing of step S67 in a longer cycle than a half cycle. That is, in such a case, the controller 33 might not determine each of the ON timings every half cycle. Once the controller 33 determines ON timings in a particular half cycle, the controller 33 may use the same ON timings in two or more successive half cycles subsequent to the particular half cycle. Thus, the main heater 31 and the auxiliary heater 32 are turned on at the respective same ON timings in the half cycles subsequent to the particular half cycle as the ON timings used in the particular half cycle.

In the alternative example of the first illustrative embodiment, in response to the heater current reaching the threshold TH1 of the current range ΔIa, the controller 33 turns the auxiliary heater 32 off. Nevertheless, in other embodiments, for example, the controller 33 might not necessarily turn the auxiliary heater 32 on and off during each half cycle, i.e., the controller 33 may cause the auxiliary heater 32 to stay on continuously in each half cycle, if the heater current that may pass through the auxiliary heater 32 that is assumed to have undergone the wave number control is estimated not to exceed the rated current TH2 of the current range ΔIa. More specifically, for example, the step for determining whether the heater current detected based on the currently input signal Sig1 has reached the threshold TH1 of the current range ΔIa and the step for turning the auxiliary heater 32 off may be both omitted. In such a case, for turning the auxiliary heater 32 off at a zero-crossing timing, the heater control circuit 43 for controlling the auxiliary heater 32 may include a triac as with the heater control circuit 143.

In the examples of the first illustrative embodiment, the heater control circuits 43 and 44 each include an IGBT. Nevertheless, in other embodiments, for example, the heater control circuits 43 and 44 may each include another semiconductor device such as a field-effect transistor ("FET"). In still other embodiments, for example, the heater control circuits 43 and 44 may each include another semiconductor device such as a thyristor.

Examples of the current sensor includes the current sensor 37 that is disposed on the line connecting between the AC supply 101 and the AC/DC convertor 34. Nevertheless, in other embodiments, for example, a current sensor may be disposed on a route that may be branched off from the line connecting between the AC supply 101 and the AC/DC convertor 34 and may extend to the relay 42. In still other embodiments, for example, two current sensors may be provided. More specifically, the current sensors may include a current sensor that may be disposed on a route that may be branched off from a line connecting the relay 42 to the main heater 31 and the auxiliary heater 32 and may extend to the main heater 31, and another current sensor that may be disposed on a route that may be branched off from a line connecting the relay 42 to the main heater 31 and the auxiliary heater 32 and may extend to the auxiliary heater 32.

In the illustrative embodiment, the main heater 31 consumes more power than the auxiliary heater 32. Nevertheless, in other embodiments, for example, the auxiliary heater 32 may consume more power than the main heater 31. The one or more aspects of the disclosure may be applied to any image processing device including two heaters.

Example of the image forming apparatus includes other printers such as a color laser printer and a printer for forming an electrostatic latent image on a circumferential surface of a photosensitive drum by irradiation using an LED, and multifunction devices having multiple functions such as a copying function, as well as the monochrome laser printer 1.

In the examples of the first illustrative embodiment, in response to the heater current reaching the threshold TH1, the controller 33 turns the main heater 31 off. Nevertheless, in other embodiments, for example, the controller 33 may turn the main heater 31 off at any timing after a time period equal to the time period TD1 elapses and before the heater current reaches the threshold TH1. In still other embodiments, for example, in response to a time period equal to the time period TD1 elapsing from turning-off of the auxiliary heater 32, the controller 31 may turn the main heater 31 off

What is claimed is:

1. A heating system, comprising:

a first heater;

a current sensor connected in series to the first heater;

a first switch connected in series to the first heater, the first switch configured to:

in response to receiving a first ON signal, change to a conducting state to supply an alternating current signal to the first heater; and in response to receiving a first OFF signal, change to a non-conducting state to halt supply of the alternating current signal to the first heater;

a second heater connected in parallel to the first heater and the first switch and in series to the current sensor; and a second switch connected in series to the second heater and in parallel to the first heater, the second switch configured to, in response to receiving a second ON signal, change to a conducting state to supply an alternating current signal to the second heater, and a controller configured to:

output the first ON signal to the first switch at a first time, the first time occurring during a portion of a half cycle of the alternating current signal having increasing amplitude;

output the first OFF signal to the first switch at a second time in response to change of a signal received from the current sensor from being less than a first threshold to being within a predetermined range, the predetermined range having a minimum value equal to the first threshold and a maximum value equal to a second threshold; and output the second ON signal to the second switch at a third time prior to the second time within the half cycle, and wherein the second time at which the signal received from the current sensor changes from being less than the first threshold to being within the predetermined range is further based on outputting the second ON signal to the second switch at the third time.

2. The heating system according to claim 1, wherein the first time and the third time occur at a zero-crossing timing.

3. The heating system according to claim 1, wherein the second switch is further configured to, in response to receiving a second OFF signal, change to the non-conducting state to halt supply of the alternating current signal to the second heater, and wherein, in a case where a peak of current that is assumed to pass through the second heater during the half cycle exceeds the second threshold, the controller is configured to output the second OFF signal to the second switch at a fourth time before the signal received from the current sensor exceeds the second threshold during the half cycle.

4. The heating system according to claim 3, wherein the fourth time is determined based on a predetermined time period from the second time.

5. The heating system according to claim 4, wherein the fourth time occurs in response to change of the signal received from the current sensor after outputting of the first OFF signal to the first switch, from being less than the first threshold to being within the predetermined range.

6. The heating system according to claim 5, wherein the first heater is configured to consume less power than the second heater.

7. The heating system according to claim 6, wherein the controller is further configured to, in response to change of the signal received from the current sensor after outputting of the first OFF signal to the first switch, from being less than the first threshold to being within the predetermined range in the half cycle, output the first ON signal to the first switch at a fifth time before the signal received from the current sensor exceeds the second threshold.

8. The heating system according to claim 7, wherein the controller is further configured to output the first OFF signal to the first switch at a sixth time in response to change of the signal received from the current sensor from being less than the first threshold to being within the predetermined range after outputting of the second OFF signal to the second switch at the fourth time and the first ON signal to the first switch at the fifth time.

9. The heating system according to claim 3, wherein the second switch includes an IGBT.

10. The heating system according to claim 1, wherein the first switch includes an IGBT.

11. The heating system according to claim 1, wherein the first heater and the second heater are installed within an image forming apparatus.

12. A heating system comprising:

a first heater;

a second heater;

a first switch electrically connected between an alternating current power signal and the first heater;

a second switch electrically connected between the alternating current power signal and the second heater;

a current sensor configured to output a current monitoring signal indicating a current level of the alternating current power signal; and a controller electrically connected to the first switch and the second switch and receiving the current monitoring signal from the current sensor, the controller configured to:

activate the first switch and the second switch to provide the alternating current power signal to the first heater and the second heater during a portion of a half cycle of the alternating current power signal having increasing amplitude; and upon the current monitoring signal reaching a predetermined threshold within the half cycle, deactivate at least one of the first switch or the second switch to electrically disconnect the alternating current power signal from the corresponding first or second heater, wherein deactivating at least one of the first switch or the second switch comprises deactivating the first switch at a first time and deactivating the second switch at a second time different from the first time.

13. The heating system according to claim 12, wherein the threshold is a current level below a maximum allowable current level.

14. The heating system according to claim 12, wherein the first switch and first heater are electrically connected to the alternating current power supply in parallel with the second switch and second heater.

* * * * *